US006203429B1

(12) United States Patent
Demar et al.

(10) Patent No.: US 6,203,429 B1
(45) Date of Patent: Mar. 20, 2001

(54) GAMING MACHINE WITH BONUS MODE

(75) Inventors: Lawrence E. Demar; Erica Frohm; William A. Grupp; Scott Slomiany, all of Chicago, IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/140,947

(22) Filed: Aug. 27, 1998

Related U.S. Application Data

(63) Continuation-in-part of application No. 08/835,840, filed on Apr. 23, 1997.

(51) Int. Cl.[7] ..... G07F 17/34
(52) U.S. Cl. ..... 463/20; 463/25; 273/143 R
(58) Field of Search ..... 273/143 R, 138.1, 273/138.2, 138 A; 463/20, 25

(56) References Cited

U.S. PATENT DOCUMENTS

| | | | |
|---|---|---|---|
| 4,095,795 | 6/1978 | Saxton et al. | 273/143 R |
| 4,448,419 | 5/1984 | Telnaes | 273/143 R |
| 4,721,307 | 1/1988 | Okada | 273/143 R |
| 5,393,057 | 2/1995 | Marnell, II | 273/143 R |
| 5,393,061 | 2/1995 | Manship et al. | 273/143 R |
| 5,722,891 | 3/1998 | Inoue | 463/20 |
| 5,749,580 | 5/1998 | Lopez | 273/243 |
| 5,788,573 | 8/1998 | Baerlocher et al. | 463/16 |
| 5,820,459 | 10/1998 | Acres et al. | 463/25 |
| 5,823,874 | 10/1998 | Adams | 463/17 |
| 5,848,932 | 12/1998 | Adams | 463/20 |
| 5,882,261 | 3/1999 | Adams | 463/20 |

FOREIGN PATENT DOCUMENTS

| | | | |
|---|---|---|---|
| 3638099 | 5/1988 | (DE) . | |
| 0148001 | 7/1985 | (EP) . | |
| 0333338 | 2/1989 | (EP) | G07F/17/32 |
| 1129607 | 10/1968 | (GB) . | |
| 2083936 | 9/1980 | (GB) | G07F/17/34 |
| 1591623 | 6/1981 | (GB) | G07F/17/34 |
| 2084371 | 4/1982 | (GB) . | |
| 2096376 | 10/1982 | (GB) | G07F/17/34 |
| 2106685 | 4/1983 | (GB) . | |
| 2072395 | 2/1984 | (GB) . | |
| 2153572 | 8/1985 | (GB) | G07F/17/34 |
| 2197974 | 10/1986 | (GB) | G07F/17/34 |
| 2180087 | 3/1987 | (GB) . | |
| 2181589 | 4/1987 | (GB) | G07F/17/34 |
| 2191030 | 10/1987 | (GB) | G07F/17/34 |
| 2202984 | 10/1988 | (GB) | G07F/17/34 |
| 2210191 | 6/1989 | (GB) | G07F/17/34 |
| 2230373 | 10/1990 | (GB) | G07F/17/34 |
| 2242300 | 9/1991 | (GB) | G07F/17/34 |
| 2262642 | 6/1993 | (GB) | G07F/17/34 |
| 2273384 | 6/1994 | (GB) | G07F/17/34 |
| WO 94/01840 | 1/1994 | (WO) | G07F/17/34 |

OTHER PUBLICATIONS

"Viva! Six! Las Vegas" Game Advertisement; BarCrest; 2 pgs.; Date Unknown.

(List continued on next page.)

*Primary Examiner*—Benjamin H. Layno
(74) *Attorney, Agent, or Firm*—Piper Marbury Rudnick & Wolfe

(57) ABSTRACT

A gaming machine is operated by a programmed micro-processor in which the first mode of operation, a basic gambling game, is implemented such as video poker or reel-type slot machine play. If bonus symbols are selected in the basic mode, a bonus mode is triggered. In the bonus mode the same or a different game is implemented by the micro-processor system employing a variable probability trial procedure in which the player continues to play and receive awards until a losing combination occurs. The hit rate for the bonus mode is often significantly greater than 50% although the overall hold percentage of the game remains below 100%.

14 Claims, 19 Drawing Sheets

OTHER PUBLICATIONS

"Road Hog" Game Advertisement; Barcrest; 2 pgs.; Date Unknown.
"Premier Club Manager" Game Advertisement; Bell–Fruit Manufacturing; 2 pgs.; Date Unknown.
"Only Fools and Horses" Game Advertisement; Bell–Fruit Manufacturing; 2 pgs.; Date Unknown.
"Monopoly" Game Advertisement; Maygay; 2 pgs.; Date Unknown.
"Monopoly Deluxe" SWP Game Brochure; JPM Ltd; 4 pgs.; Date Unknown.
"Main Attraction" Game Advertisement; Bell–Fruit Manufacturing; 2 pgs.; Date Unknown.
"Lucky Horseshoes" Advertisement; JPM Ltd; 4 pgs.; Date Unknown.
"Club Vegas" Advertisement; Barcrest; 2 pgs.; Date Unknown.
"Big Breakfast" Game Advertisement; Bell–Fruit Manufacturing; 2 pgs.; Date Unknown.
"Adders & Ladders" Game Advertisement; Barcrest; 2 pgs.; Date Unknown.
"Piggy Bankin'" Game Advertisement Sheet; WMS Gaming Inc.; 1 pgs.; Date Unknown.
"Monopoly—The Trivia Quiz Game" SWP Game Brochure; JPM Ltd; 4 pgs.; Date Unknown.
Winning Streak Game Brochure, WMS Gaming Inc.
Jackpot Stampede Game Brochure, WMS Gaming Inc.

FIG. 2

| BASE GAME | | | | | |
|---|---|---|---|---|---|
| BASE GAME | | | | | |
| SYMBOLS | REEL1 | REEL2 | REEL3 | | |
| WINSTREAK | 2 | 3 | 1 | | |
| WSBLANK | 4 | 6 | 2 | | |
| 3BAR | 4 | 1 | 1 | | |
| 2BAR | 3 | 2 | 2 | | |
| 1BAR | 2 | 4 | 6 | | |
| BLANKS | 7 | 5 | 9 | | |
| CHERRY | 0 | 1 | 1 | | |
| | 22 | 22 | 22 | | |

FIG. 2A

| COMBINED GAME PAY SCHEDULE | | | | | |
|---|---|---|---|---|---|
| COMB | PAY | PROB | EV | PULLS | MAXCONT |
| 3WINSTREAK | 55.46652 | 0.000563 | 0.031255 | 1774.667 | 3.310713 |
| 3ANYSTREAK | 27.73326 | 0.014651 | 0.40631 | 68.25641 | 43.03927 |
| 3BARS | 50 | 0.000376 | 0.018783 | 2662 | 1.989617 |
| 2BARS | 20 | 0.001127 | 0.022539 | 887.3333 | 2.38754 |
| 1BARS | 10 | 0.004508 | 0.045079 | 221.8333 | 4.77508 |
| ANYBAR | 5 | 0.047239 | 0.236195 | 21.16899 | 25.01943 |
| 2CHERRY | 5 | 0.002066 | 0.010331 | 484 | 1.094289 |
| CHERRY | 2 | 0.086777 | 0.173554 | 11.52381 | 18.38406 |
| | | 0.157307 | 0.944045 | | |

FIG. 2B

| BASE GAME REELSTRIPS | | | |
|---|---|---|---|
| | REEL1 | REEL2 | REEL3 |
| 1 | 2BAR | 2BAR | 1BAR |
| 2 | | | |
| 3 | 3BAR | 1BAR | 2BAR |
| 4 | | | |
| 5 | STREAK | STREAK | 1BAR |
| 6 | | | |
| 7 | 1BAR | 3BAR | 3BAR |
| 8 | | | |
| 9 | 3BAR | 1BAR | 1BAR |
| 10 | | | |
| 11 | 2BAR | STREAK | STREAK |
| 12 | | | |
| 13 | STREAK | CHERRY | 1BAR |
| 14 | | | |
| 15 | 3BAR | 1BAR | CHERRY |
| 16 | | | |
| 17 | 1BAR | STREAK | 1BAR |
| 18 | | | |
| 19 | 2BAR | 2BAR | 2BAR |
| 20 | | | |
| 21 | 3BAR | 1BAR | 1BAR |
| 22 | | | |

FIG. 3

| BONUS GAME | | | | | | |
|---|---|---|---|---|---|---|
| SYMBOL | REEL1 | REEL2 | REEL3 | | | |
| REDSEVEN | 1 | 1 | 1 | | | |
| BLUESEVEN | 1 | 1 | 1 | | | |
| 3BAR | 6 | 6 | 4 | | | |
| 2BAR | 4 | 4 | 5 | | | |
| 1BAR | 6 | 6 | 6 | | | |
| CHERRY | 4 | 4 | 5 | | | |
| | 22 | 22 | 22 | | | |
| | 10648 | | | | | |
| | | | | | | |
| BONUS GAME PAY SCHEDULE | | | | | | |
| COMB | PAY | PROB | EV | PULLS | | |
| REDSEVEN | 1500 | 9.39E-05 | 0.140872 | 10648 | | |
| BLUESEVENS | 500 | 9.39E-05 | 0.046957 | 10648 | | |
| ANYSEVEN | 100 | 0.000563 | 0.056349 | 1774.667 | | |
| 3BARS | 50 | 0.013524 | 0.676183 | 73.94444 | | |
| 2BARS | 20 | 0.007513 | 0.150263 | 133.1 | | |
| 1BAR | 10 | 0.020285 | 0.202855 | 49.2963 | | |
| 3CHERRIES | 10 | 0.007513 | 0.075131 | 133.1 | | |
| ANYBAR | 5 | 0.319309 | 1.596544 | 3.131765 | | |
| 2CHERRIES | 5 | 0.093163 | 0.465815 | 10.73387 | | |
| CHERRY | 2 | 0.382044 | 0.764087 | 2.617502 | | |
| | | 0.844102 | 4.175056 | | | |
| | | | | | | |
| BONUS GAME FEATURE | | | | | | |
| S=EXPECTED # OF SPINS (WINNING SPINS + 1 LOSER TO END FEATURE) | | | | | | 6.414458 |
| X=EXPECTED WIN PER SPIN | | | | | | 4.175056 |
| C=EXPECTED WIN FROM FEATURE | | | | | | 26.78072 |
| | | | | | | |
| BONUS GAME TOTAL | | | | | | |
| TOTAL FROM BONUS GAME SPINS | | | | | | 26.78072 |
| TOTAL FROM 2ND CHANCE FEATURE | | | | | | 0.952536 |
| | | | | | | 27.73326 |

FIG. 3A

| PAY TABLE | | |
|---|---|---|
| COMBINATION | 1ST COIN | 2ND COIN |
| RED SEVENS | 1500 | 3000 |
| BLUE SEVENS | 500 | 1000 |
| ANY SEVEN | 100 | 200 |
| 3BARS | 50 | 100 |
| 2BARS | 20 | 40 |
| 1BARS | 10 | 20 |
| 3 CHERRIES | 10 | 20 |
| ANY BAR | 5 | 10 |
| 2 CHERRIES | 5 | 10 |
| 1 CHERRY | 2 | 4 |

FIG. 7

| SECOND CHANCE WHEEL | | | | | | | |
|---|---|---|---|---|---|---|---|
| PAY | COUNT | PROB | EV | | | | |
| 3 | 32 | 0.32 | 0.96 | | | | |
| 5 | 45 | 0.45 | 2.25 | | | | |
| 10 | 20 | 0.2 | 2 | | | | |
| 20 | 2 | 0.02 | 0.4 | | | | |
| 50 | 1 | 0.01 | 0.5 | | | | |
| | 100 | 1 | 6.11 | | | | |
| | | | | | | | |
| EXPECTED VALUE OF 2ND CHANCE WHEEL | | | | | | | 6.11 |
| PROBABILITY OF SPINING 2ND CHANCE WHEEL | | | | | | | 0.155898 |
| EXPECTED VALUE ADDED TO BONUS GAME FROM 2ND CHANCE WHEEL | | | | | | | 0.952536 |

FIG 9

| Stop | Reel 1 | Reel 2 | Reel 3 |
|---|---|---|---|
| 1 | 3 BAR | 3 BAR | 3 BAR |
| 2 | | (blank/A) | (Surprise) |
| 3 | 1 BAR | 1 BAR/R | 2 BAR |
| 4 | (Surprise) | (blank/B) | |
| 5 | SEVEN | 2 BAR | 1 BAR |
| 6 | | | (blank/A) |
| 7 | 1 BAR | SEVEN | SEVEN/R |
| 8 | (blank/A) | | (blank/B) |
| 9 | 3 BAR/R | 1 BAR | 1 BAR |
| 10 | (blank/B) | (Surprise) | |
| 11 | 1 BAR | 2 BAR | 2 BAR |
| 12 | (Surprise) | (blank/A) | (Surprise) |
| 13 | 2 BAR | WILD/R | 1 BAR |
| 14 | | (blank/B) | (Surprise) |
| 15 | 1 BAR | 2 BAR | 2 BAR |
| 16 | (Surprise) | (Surprise) | |
| 17 | 3 BAR | CHERRY | 1 BAR |
| 18 | (blank/A) | | |
| 19 | 2 BAR/R | 1 BAR | 2 BAR |
| 20 | (blank/B) | | |
| 21 | 1 BAR | RANDOM | 1 BAR |
| 22 | | | |
| 23 | 2 BAR | 1 BAR | 2 BAR |
| 24 | | (Surprise) | |

FIGURE 10 reel symbol probabilities

| SYMBOL | reel 1 occur | reel 1 prob | reel 2 occur | reel 2 prob | reel 3 occur | reel 3 prob |
|---|---|---|---|---|---|---|
| 3 Bar | 2 | 0.083333 | 1 | 0.041667 | 1 | 0.04167 |
| 3Bar/R | 1 | 0.041667 | 0 | 0 | 0 | 0 |
| 2 Bar | 2 | 0.083333 | 3 | 0.125 | 5 | 0.20833 |
| 2 Bar/R | 1 | 0.041667 | 0 | 0 | 0 | 0 |
| 1 Bar | 5 | 0.208333 | 3 | 0.125 | 5 | 0.20833 |
| 1 Bar/R | 0 | 0 | 1 | 0.041667 | 0 | 0 |
| Wild/R | 0 | 0 | 1 | 0.041667 | 0 | 0 |
| Random | 0 | 0 | 1 | 0.041667 | 0 | 0 |
| Cherry | 0 | 0 | 1 | 0.041667 | 0 | 0 |
| Seven | 1 | 0.041667 | 1 | 0.041667 | 0 | 0 |
| Seven/R | 0 | 0 | 0 | 0 | 1 | 0.04167 |
| Surprise | 3 | 0.125 | 3 | 0.125 | 3 | 0.125 |
| Blank | 5 | 0.208333 | 5 | 0.208333 | 7 | 0.29167 |
| Blank/A | 2 | 0.083333 | 2 | 0.083333 | 1 | 0.04167 |
| Blank/B | 2 | 0.083333 | 2 | 0.083333 | 1 | 0.04167 |
| total | 24 | 1 | 24 | 1 | 24 | 1 |

Total Combinations
13824

FIG 11

| Pays | Reel 1 | Reel 2 | Reel 3 | #/Reel 1 | #/Reel 2 | #/Reel 3 | Hits |
|---|---|---|---|---|---|---|---|
| 1000 | Seven | Wild/R | Seven/R | 1 | 1 | 1 | 1 |
| 210 | Seven | Seven | Seven/R | 1 | 1 | 1 | 1 |
| 80 | any 3 Bar | 3 Bar | 3 Bar | 3 | 1 | 1 | 3 |
| 80 | any 3 Bar | Wild/R | 3 Bar | 3 | 1 | 1 | 3 |
| 60 | any 2 Bar | 2 Bar | 2 Bar | 3 | 3 | 5 | 45 |
| 60 | any 2 Bar | Wild/R | 2 Bar | 3 | 1 | 5 | 15 |
| 20 | 1 Bar | any 1 Bar | 1 Bar | 5 | 4 | 5 | 100 |
| 20 | 1 Bar | Wild/R | 1 Bar | 5 | 1 | 5 | 25 |
| 15 | anybar | anybar | anybar | 11 | 8 | 11 | 820 |
| 15 | anybar | Wild/R | anybar | 11 | 1 | 11 | 78 |
| 6 | any blank | Cherry | any blank | 12 | 1 | 12 | 144 |
| 6 | any sym | Cherry | any blank | 12 | 1 | 12 | 144 |
| 6 | any blank | Cherry | any sym | 12 | 1 | 12 | 144 |
| 6 | any sym | Cherry | any sym | 12 | 1 | 12 | 144 |
| 3 | Blank | Wild/R | blank/AB | 5 | 1 | 2 | 10 |
| 3 | Blank | Wild/R | surprise | 5 | 1 | 3 | 15 |
| 3 | Blank | Wild/R | Blank | 5 | 1 | 7 | 35 |
| 3 | Blank | Wild/R | any sym | 5 | 1 | 12 | 60 |
| 3 | surprise | Wild/R | Blank | 3 | 1 | 7 | 21 |
| 3 | surprise | Wild/R | any sym | 3 | 1 | 12 | 36 |
| 3 | surprise | Wild/R | Blank/AB | 3 | 1 | 2 | 6 |
| 3 | Blank/AB | Wild/R | Blank | 4 | 1 | 7 | 28 |
| 3 | Blank/AB | Wild/R | surprise | 4 | 1 | 3 | 12 |
| 3 | any sym | Wild/R | surprise | 12 | 1 | 3 | 36 |
| 3 | surprise | Wild/R | surprise | 3 | 1 | 3 | 9 |
| 3 | any sym | Wild/R | Blank | 12 | 1 | 7 | 84 |
| 3 | 3 Bar | Wild/R | blank/AB | 2 | 1 | 2 | 4 |
| 3 | 2 Bar | Wild/R | blank/AB | 2 | 1 | 2 | 4 |
| 3 | 1 Bar | Wild/R | blank/AB | 5 | 1 | 2 | 10 |
| 3 | blank/AB | Wild/R | 3 Bar | 4 | 1 | 1 | 4 |
| 3 | blank/AB | Wild/R | 2 Bar | 4 | 1 | 5 | 20 |
| 3 | blank/AB | Wild/R | 1 Bar | 4 | 1 | 5 | 20 |
| 3 | 3 Bar | Wild/R | Seven/R | 2 | 1 | 1 | 2 |
| 3 | 2 Bar | Wild/R | Seven/R | 2 | 1 | 1 | 2 |
| 3 | 1 Bar | Wild/R | Seven/R | 5 | 1 | 1 | 5 |
| 3 | Seven | Wild/R | blank/AB | 1 | 1 | 2 | 2 |
| 3 | Seven | Wild/R | anybar | 1 | 1 | 11 | 11 |
| Feature Pay | Seven | Random | Seven/R | 1 | 1 | 1 | 1 |
| Feature Pay | any 3 Bar | Random | 3 Bar | 3 | 1 | 1 | 3 |
| Feature Pay | any 2 Bar | Random | 2 Bar | 3 | 1 | 5 | 15 |
| Feature Pay | 1 Bar | Random | 1 Bar | 5 | 1 | 5 | 25 |
| Feature Pay | anybar | Random | anybar | 11 | 1 | 11 | 78 |
| Feature Pay | any Uncle | any Uncle | any Uncle | 6 | 6 | 3 | 108 |
| Feature Pay | Surprise | Surprise | Surprise | 3 | 3 | 3 | 27 |

Total Hits: 2360
Total Combinations: 13824

FIG 12

| Pays | Pay/1Coin | Pay/2Coin | Pay/3Coin | Pay/4Coin | 1-3 prob | 4cn prob | 1 cn EV | 2 cn EV | 3 cn EV | 4 cn EV | 4 th coin Pulls/Hit | Mx. Contr |
|---|---|---|---|---|---|---|---|---|---|---|---|---|
| non-win | 0 | 0 | 0 | 0 | 0.83774595 | 0.82928241 | 0 | 0 | 0 | 0 | 1.20586183 | 0 |
| 1 Wild | 1 | 2 | 3 | 3 | 0.03284144 | 0.03153935 | 0.03284144 | 0.03284144 | 0.03284144 | 0.02365451 | 31.706422 | 0.02488724 |
| 1 Cherry | 2 | 4 | 6 | 6 | 0.04166667 | 0.04166667 | 0.08333333 | 0.08333333 | 0.08333333 | 0.0625 | 24 | 0.06575712 |
| anybar | 5 | 10 | 15 | 15 | 0.06495949 | 0.06495949 | 0.32479745 | 0.32479745 | 0.32479745 | 0.24359809 | 15.3942094 | 0.25629294 |
| 1 Bars | 10 | 20 | 30 | 30 | 0.00904225 | 0.00904225 | 0.09042245 | 0.09042245 | 0.09042245 | 0.06781684 | 110.592 | 0.07135104 |
| anybar/Rnd | 17.5470588 | 35.0941176 | 52.6411765 | 52.6411765 | 0.00564236 | 0.00564236 | 0.09900684 | 0.09900684 | 0.09900684 | 0.07425513 | 110.592 | 0.07812486 |
| 2 Bars | 20 | 40 | 60 | 60 | 0.00434028 | 0.00434028 | 0.08680556 | 0.08680556 | 0.08680556 | 0.06510417 | 230.4 | 0.068497 |
| 1 Bar/Rnd | 31.1352941 | 62.2705882 | 93.4058824 | 93.4058824 | 0.00180845 | 0.00180845 | 0.05630659 | 0.05630659 | 0.05630659 | 0.04222995 | 552.96 | 0.04443071 |
| 3 Bars | 40 | 80 | 120 | 120 | 0.00043403 | 0.00043403 | 0.01736111 | 0.01736111 | 0.01736111 | 0.01302083 | 2304 | 0.0136994 |
| 2 Bar/Rnd | 58.3117647 | 116.623529 | 174.935294 | 174.935294 | 0.00108507 | 0.00108507 | 0.06327231 | 0.06327231 | 0.06327231 | 0.04745424 | 921.6 | 0.04992726 |
| Sevens | 70 | 140 | 210 | 210 | 7.2338E-05 | 7.2338E-05 | 0.00506366 | 0.00506366 | 0.00506366 | 0.00379774 | 13824 | 0.00399566 |
| 3 Bar/Rnd | 112.664706 | 225.329412 | 337.994118 | 337.994118 | 0.00021701 | 0.00021701 | 0.02444981 | 0.02444981 | 0.02444981 | 0.01833735 | 4608 | 0.01929299 |
| Seven/Rnd | 194.194118 | 388.388235 | 582.582353 | 582.582353 | 7.2338E-05 | 7.2338E-05 | 0.01404761 | 0.01404761 | 0.01404761 | 0.01053571 | 13824 | 0.01108476 |
| 7-Wild-7 | 200 | 400 | 1000 | 1000 | 7.2338E-05 | 7.2338E-05 | 0.01446759 | 0.01446759 | 0.02411265 | 0.01808449 | 13824 | 0.01902694 |

| 1st to 3rd coin totals: | Hit Rate | Coin 1 % | Coin 2 % | Coin 3 % | Pulls/Hit |
|---|---|---|---|---|---|
| | 0.16225405 | 0.91217576 | 0.91217576 | 0.92182082 | 6.16317432 |

| | | | | | | | | | |
|---|---|---|---|---|---|---|---|---|---|
| Bonus | 0 | 0 | 0 | 106.528105 | 0.0078125 | 0.2080627 | 128 | 0.21890566 |
| Surprise | 0 | 0 | 0 | 106.528105 | 0.00195313 | 0.05201568 | 512 | 0.05472642 |

| 4th Coin totals: | Hit Rate | Coin 4 % | Pulls/Hit |
|---|---|---|---|
| | 0.17071759 | 0.95046743 | 5.85762712 |

FIG 13A

Postion 1 Movement amount table

| value | occur | prob |
|---|---|---|
| 2 | 1 | 0.0087719 |
| 3 | 1 | 0.0087719 |
| 4 | 1 | 0.0087719 |
| 5 | 20 | 0.1754386 |
| 6 | 24 | 0.2105263 |
| 7 | 30 | 0.2631579 |
| 8 | 16 | 0.1403509 |
| 9 | 12 | 0.1052632 |
| 10 | 1 | 0.0087719 |
| 11 | 6 | 0.0526316 |
| 12 | 2 | 0.0175439 |
| total occurance | | |
| | 114 | |

FIG 13B

Position 2 Movement amount table

| value | occur | prob |
|---|---|---|
| 2 | 1 | 0.0243902 |
| 3 | 6 | 0.1463415 |
| 4 | 3 | 0.0731707 |
| 5 | 4 | 0.097561 |
| 6 | 4 | 0.097561 |
| 7 | 5 | 0.1219512 |
| 8 | 4 | 0.097561 |
| 9 | 10 | 0.2439024 |
| 10 | 2 | 0.0487805 |
| 11 | 1 | 0.0243902 |
| 12 | 1 | 0.0243902 |
| total occurance | | |
| | 41 | |

FIG 14

| POSITIO | VALUE | |
|---|---|---|
| 1 | VARIABL | (Depends on which |
| 2 | 4 | circuit of board) |
| 3 | 4.369 | (Average) |
| 4 | 4 | |
| 5 | END | |
| 6 | 10 | |
| 7 | 6 | |
| 8 | 6.114 | (Average) |
| 9 | 6 | |
| 10 | 6 | |
| 11 | END | |
| 12 | 8 | |
| 13 | 20.625 | (Average) |
| 14 | 8 | |
| 15 | 8 | |
| 16 | 10 | |
| 17 | 10 | |
| 18 | 6.865 | (Average) |
| 19 | 10 | |
| 20 | 10 | |

| POSITIO | VALUE | |
|---|---|---|
| 21 | 51.5 | (Average) |
| 22 | 15 | |
| 23 | 2.741 | (Average) |
| 24 | 15 | |
| 25 | 15 | |
| 26 | 10 | |
| 27 | 20 | |
| 28 | 20 | |
| 29 | 18.889 | (Average) |
| 30 | 20 | |
| 31 | END | |
| 32 | 25 | |
| 33 | 50 | |
| 34 | 8.969 | (Average) |
| 35 | 100 | |
| 36 | 10 | |
| 37 | 3.745 | (Average) |
| 38 | 250 | |
| 39 | END | |
| 40 | 500 | |

FIG 15

Movement amount table

| value | occur | prob |
|---|---|---|
| 2 | 10 | 0.0841424 |
| 3 | 1 | 0.0084142 |
| 4 | 10 | 0.0841424 |
| 5 | 12 | 0.1009709 |
| 6 | 4 | 0.033657 |
| 7 | 6 | 0.0504854 |
| 8 | 10 | 0.0841424 |
| 9 | 3 | 0.0252427 |
| 10 | 2 | 0.0168285 |
| 11 | 1 | 0.0084142 |
| 12 | 1 | 0.0084142 |
| total occurance | | |
| | 60 | |

Event Table

| Name | value | occur | prob | EV |
|---|---|---|---|---|
| Award 1 | 10 | 2 | 0.019417476 | 0.19417 |
| Award 2 | 5 | 20 | 0.194174757 | 0.97087 |
| Award 3 | 25 | 2 | 0.019417476 | 0.48544 |
| Award 4 | 50 | 2 | 0.019417476 | 0.97087 |
| Award 5 | 5 | 20 | 0.194174757 | 0.97087 |
| Award 6 | 10 | 2 | 0.019417476 | 0.19417 |
| Award 7 | 20 | 2 | 0.019417476 | 0.38835 |
| Award 8 | 10 | 2 | 0.019417476 | 0.19417 |
| Goto position 11 | | 50 | 0.485436893 | |
| Goto position 41 | | 1 | 0.009708738 | |
| total occurance | | 103 | | |
| after card: | | | 0.504854369 | |
| | | | total EV | 4.36893 |

FIG 17

| Set # | occur |
|---|---|
| 1 | 2 |
| 2 | 1 |
| 3 | 1 |
| 4 | 1 |
| 5 | 1 |
| 6 | 1 |
| 7 | 1 |
| 8 | 1 |
| 9 | 1 |
| 10 | 1 |
| 11 | 1 |
| 12 | 2 |
| 13 | 1 |
| 14 | 2 |

TOTAL OCCURANCE: 17

FIG 19

| | OCCUR | PROB |
|---|---|---|
| 2 coins | 24 | 0.141176 |
| 5 coins | 23 | 0.135294 |
| 10 coins | 12 | 0.070588 |
| 20 coins | 7 | 0.041176 |
| 25 coins | 10 | 0.058824 |
| 2X | 36 | 0.211765 |
| 3X | 22 | 0.129412 |
| 4X | 12 | 0.070588 |
| 5X | 8 | 0.047059 |
| 10X | 16 | 0.094118 |

tot occur: 170

FIG 18

| | OCCUR |
|---|---|
| 2 coins | 1 |
| 5 coins | 1 |
| 10 coins | 0 |
| 20 coins | 0 |
| 25 coins | 3 |
| 2X | 5 |
| 3X | 0 |
| 4X | 0 |
| 5X | 0 |
| 10X | 0 |
| | 10 |

FIG 20

| base pay | coin award bonus | multiplier award | TOTAL PAY | probability | Expected Value |
|---|---|---|---|---|---|
| 70 | 2 | | 72 | 0.141176 | 10.1647 |
| 70 | 5 | | 75 | 0.135294 | 10.1471 |
| 70 | 10 | | 80 | 0.070588 | 5.64706 |
| 70 | 20 | | 90 | 0.041176 | 3.70588 |
| 70 | 25 | | 95 | 0.058824 | 5.58824 |
| 70 | | 2 | 140 | 0.211765 | 29.6471 |
| 70 | | 3 | 210 | 0.129412 | 27.1765 |
| 70 | | 4 | 280 | 0.070588 | 19.7647 |
| 70 | | 5 | 350 | 0.047059 | 16.4706 |
| 70 | | 10 | 700 | 0.094118 | 65.8824 |

TOTAL EV: 194.194

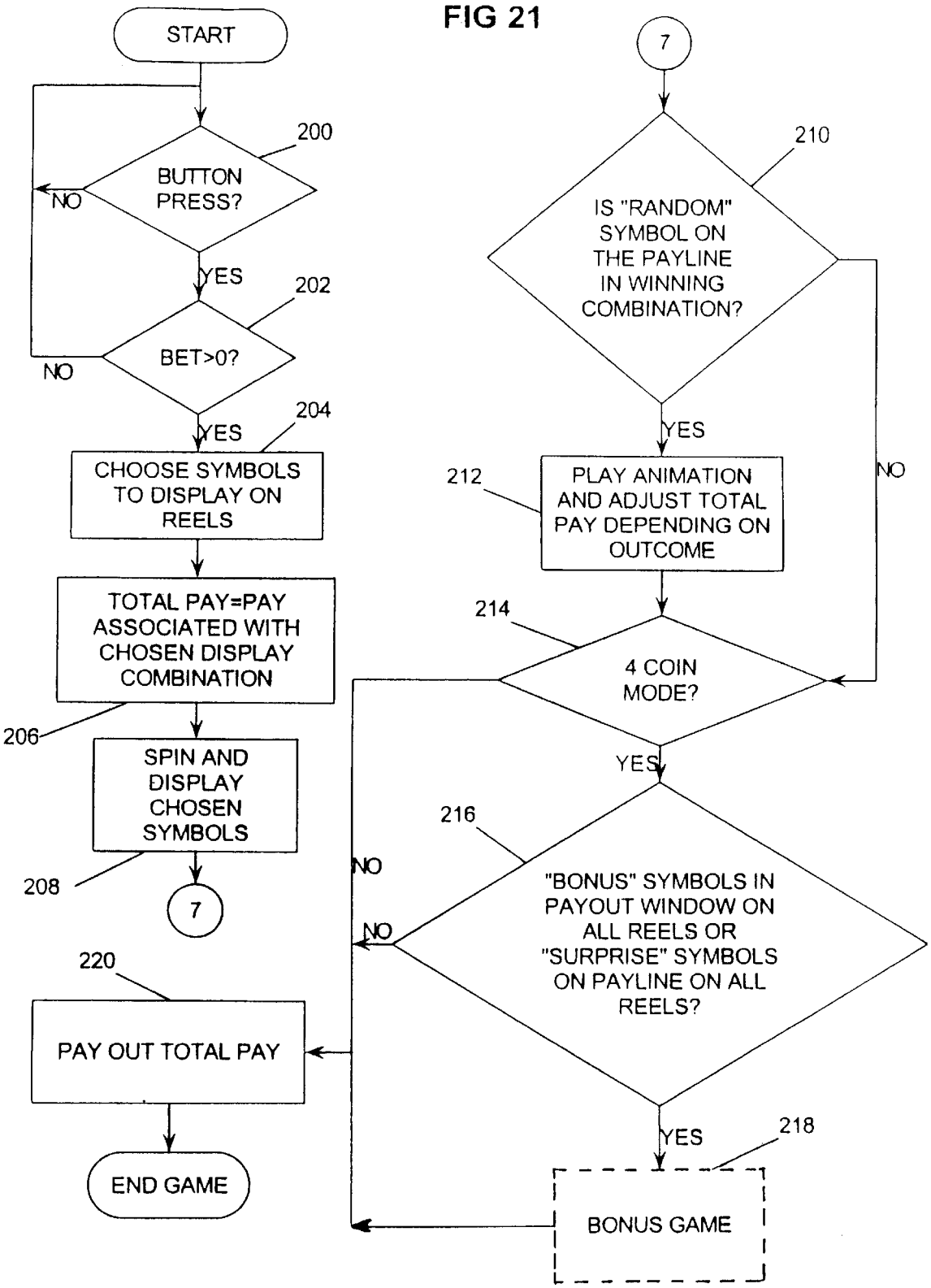
FIG 21
START
200
BUTTON PRESS?
NO
YES
202
BET>0?
NO
YES
204
CHOOSE SYMBOLS TO DISPLAY ON REELS
TOTAL PAY=PAY ASSOCIATED WITH CHOSEN DISPLAY COMBINATION
206
SPIN AND DISPLAY CHOSEN SYMBOLS
208
7
7
210
IS "RANDOM" SYMBOL ON THE PAYLINE IN WINNING COMBINATION?
YES
NO
212
PLAY ANIMATION AND ADJUST TOTAL PAY DEPENDING ON OUTCOME
214
4 COIN MODE?
YES
NO
216
"BONUS" SYMBOLS IN PAYOUT WINDOW ON ALL REELS OR "SURPRISE" SYMBOLS ON PAYLINE ON ALL REELS?
NO
YES
218
BONUS GAME
220
PAY OUT TOTAL PAY
END GAME

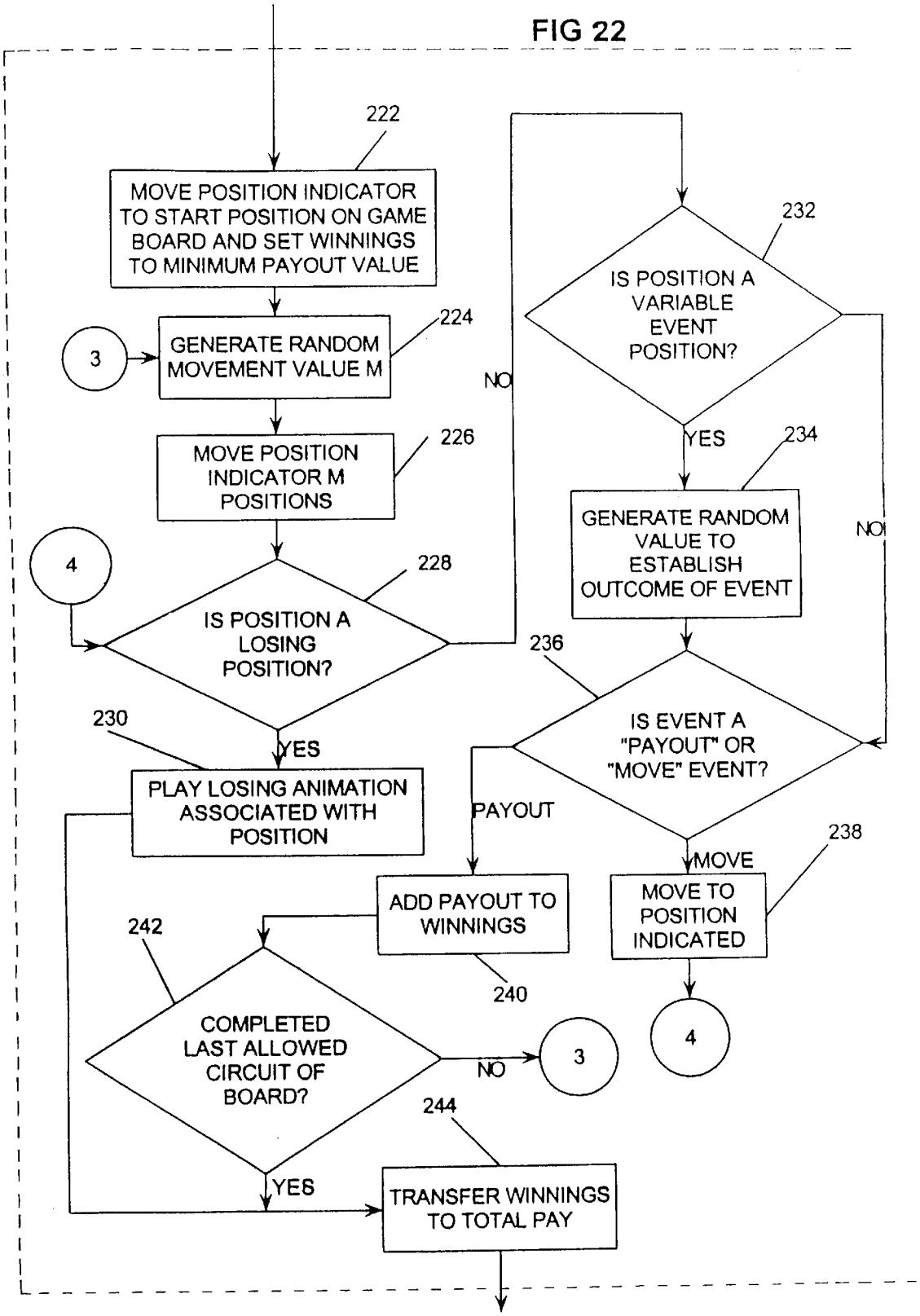
FIG 22
222
MOVE POSITION INDICATOR TO START POSITION ON GAME BOARD AND SET WINNINGS TO MINIMUM PAYOUT VALUE
3
GENERATE RANDOM MOVEMENT VALUE M
224
MOVE POSITION INDICATOR M POSITIONS
226
4
IS POSITION A LOSING POSITION?
228
NO
YES
230
PLAY LOSING ANIMATION ASSOCIATED WITH POSITION
232
IS POSITION A VARIABLE EVENT POSITION?
YES
234
GENERATE RANDOM VALUE TO ESTABLISH OUTCOME OF EVENT
NO
236
IS EVENT A "PAYOUT" OR "MOVE" EVENT?
PAYOUT
MOVE
238
MOVE TO POSITION INDICATED
ADD PAYOUT TO WINNINGS
240
242
COMPLETED LAST ALLOWED CIRCUIT OF BOARD?
NO
3
4
YES
244
TRANSFER WINNINGS TO TOTAL PAY

GAMING MACHINE WITH BONUS MODE

This application is a continuation-in-part of Application Ser. No. 08/835,840 filed Apr. 23, 1997.

BACKGROUND OF THE INVENTION

This invention relates to gaming machines. More specifically, it relates to gaming machines of the type used in casinos. Such devices include the familiar spinning reel slot machine, video slot machines, video display poker games and the like. Spinning reel slot machines have maintained their popularity evolving from electromechanical devices to the present day devices which employ micro-processor control. In modern devices the spinning reels are used merely as a display to advise a player if he has won or lost a game of chance played entirely in computer memory according to the rules embedded in a computer program. Video display type gaming machines are similar in terms of their computer program and operation but, in place of spinning reels, a CRT or dot matrix display is provided upon which a simulation of a desired game is presented. For example a poker game, a spinning reel slot machine, a blackjack game or other casino game may be simulated on the display. Whether the gaming machine uses spinning reels, a CRT display or some other manner of informing the player of game outcomes, it is necessary that the casino owner make a profit. To that end the game will be percentaged so that some portion of the revenue played into the machine is retained as profit. Thus for every dollar played, on average, a typical gaming machine will retain (hold) between 1% and 25%.

With the constraint that there must be a positive hold percentage comes the problem of offering higher awards to induce players to use the equipment. In reel spinning slot machines this has been a formidable problem because the possible outcomes are normally related to the number of stop positions per spinning reel. Thus, in the case of three reels each having 20 stop positions thereon, the probability of any three-symbol combination occurring is one in eight thousand. This provides an upper limit on the amount that may be paid out if a profit is to be made. In an effort to overcome this limitation micro-processor based machines have been developed. The game is played in the micro-processor system and the reels are used merely to display the results. Much greater odds may be employed than permitted by the reel strip size thereby increasing the possible payouts by decreasing the chances that a winning combination will occur.

U.S. Pat. No. 4,448,419 to Telnaes provides one solution to this problem. It is desired, however, according to the present invention, to provide a more universal solution which pays high awards while at the same time increasing player enjoyment. The present invention is suitable for implementation in a reel-type slot machine design as will be explained in the description of preferred embodiments. However, it may also be implemented strictly as a video game, without the use of spinning reels, or it may be used for other types of games or for combinations of games. All that is required is that there be a standard type base game which has a hold percentage built into its table of payouts. In addition, the base game must include a special symbol combination or similar mechanism by which a lucky player can qualify to play a bonus game. The bonus game may be similar to the base game, albeit with different symbol probabilities or it may be a completely separate game on the same or a different display. Thus for example, in one embodiment a reel spinning slot machine is used for the base game while a dot matrix display simulation of a slot machine or card game is used for the bonus game. In other embodiments a reel spinning slot machine is used for the base game and a lit game board display in conjunction with a dot matrix display is used for the bonus game The pay tables for the basic and bonus games must be mathematically combined such that there is still a positive hold percentage, which represents the profit for the casino establishment. Other combinations of games are clearly suitable for use with the present invention such as a reel spinning slot machine in which the basic game uses a first set of symbol probabilities and the bonus game uses a second set of symbol probabilities. Another possibility is a video poker game for the base game and wherein the bonus game could be a video slot game, or another poker game with a different pay table.

A principal feature of the present invention is the structure of the bonus game. A player must play the base game until he qualifies for the bonus game. Qualification is a low frequency event. The bonus game however is a high hit rate game in which the player is expected to win several times in a row and wherein the player is permitted to keep playing and collect his winnings (with or, optionally, without payment of additional coins by the player) until he loses. In the context of a reel-type slot machine, this may be referred to as a "spin 'till you lose" bonus game. It is believed that the thrill and excitement of a bonus game in which a player's probability of winning is high and in which he keeps playing until he loses, all the while collecting payouts, will add a new and significantly greater level of player excitement.

It is accordingly an object of the present invention to provide a gaming machine in which there is a basic game and a bonus game and wherein the bonus game has a play-until-you-lose-mode in which the player continues to accumulate winnings without returning to the basic game until a losing trial occurs in the bonus game.

It is another object of the invention to provide a combination gaming machine having basic and bonus modes wherein the basic mode occasionally initiates the bonus mode game which is a high hit-rate game in which the player may continue to play until he loses.

It is a further object of the invention to provide a dual mode gaming machine in which a bonus mode is based upon a series of Bernoulli trials which continue until the player loses. Advantageously, the probability of winning in some trials is greater than 50%.

It is a still further object of the invention to provide a dual mode gaming machine in which a bonus mode is based upon a series of trials with a variable probability outcome which continue until a losing outcome occurs. Variable probability trials comprise the generation of an outcome from a plurality of alternative outcomes, wherein the probability of each outcome varies from trial to trial. Advantageously, the probability of a winning outcome in some trials is greater than 50%.

It is yet a further object of the invention to provide a dual mode gaming machine in which a bonus mode is provided which is accessed by achieving a goal in a normal mode, and wherein the bonus mode is based on a trail type game, wherein a variable probability trial comprises the selection of a distance on the trail to move to reach a new position on the board and the selection of an outcome associated with the new position on the board from a set of one or more possible outcome associated with that position. The probability of selecting each of the outcomes associated with a particular position on the board can be constant or variable depending on the embodiment.

These and other objects of the invention will be apparent from the remaining portion of this specification.

BRIEF DESCRIPTION OF THE DRAWINGS

FIG. 2 is a symbol table for a 22 symbol reel-type slot machine augmented to include bonus symbols (WinStreak) and special blanks (WSBlank) immediately adjacent to the bonus symbols.

FIG. 2A is a math table combining the expected value calculation for the base and bonus games according to an embodiment of the invention.

FIG. 2B is a set of reel strips for the symbol table of FIG. 2 for a base game.

FIG. 3 is a combined symbol and math table for the bonus game according to an embodiment of the invention.

FIG. 3*a* is a pay table for both the base and bonus games.

FIG. 7 is a consolation table for an optional feature of the invention.

FIG. 9 is a table showing the reel strips of the example of a specific example of the second embodiment.

FIG. 10 is a table showing the number of each of the symbols on the reel strips of FIG. 9.

FIG. 11 is a table showing the values of the payouts which are obtained for achieving winning combinations on the reel strips of the example of FIG. 9.

FIG. 12 is a table showing the pay schedule of the specific example of FIG. 9.

FIGS. 13A and 13B show two tables of move values for first and second positions on a trail board of the bonus game of FIG. 9.

FIG. 14 shows the expected payouts for each position on the trail board according to a specific example of the second embodiment.

FIG. 15 shows outcome tables for a position on the trail board at which different outcomes can occur with varying probabilities.

FIG. 17 is a table showing the probabilities of selecting different payout modifier tables in a second bonus feature of the second embodiment of the invention.

FIG. 18 is an example payout modifier table which could be selected using the table of FIG. 17.

FIG. 19 is a table showing the overall probabilities of obtaining a particular payout modifier using the tables of FIGS. 17 And 18.

FIG. 20 is a table showing an example of the calculation of the expected payout from the table of FIG. 19.

FIG. 21 shows a first part of a flowchart showing the operation of a specific example of the second embodiment.

FIG. 22 shows in detail the bonus game operation of the flowchart of FIG. 21.

DETAILED DESCRIPTION

As indicated in the background portion of this specification, the present invention can be implemented using almost any type of gaming device. The game is divided into two parts: a basic game and bonus game. The basic game can be any type of game of chance. Typically it will be a spinning reel slot machine, a video poker game or similar type of game suitable for wagering. In the basic game, some event, or sequence of outcomes which occur at a low frequency permits the playing of the bonus game. The bonus game is another game of chance with a generally high hit rate (i.e., the probability that a player will win rather than lose). The hit rate of at least one of the trials in the bonus game, according to the present invention, should be greater than 50%. When a trigger event occurs in the base game, play switches to the bonus game. Preferably, play of the bonus game results in a series of free trials i.e., not requiring the game player to insert any additional coins or credits into the machine. Alternatively, however, the bonus game can be played by requiring coins or credits with the player knowing that his chance of winning has been significantly increased. If a bonus game trial results in a win, then the player receives the amount associated with that particular win and another play or trial occurs. Trials continue in the bonus game until a losing trial occurs.

As indicated previously, the basic game and bonus game may be the same game system with different pay tables and rules. For example, a video poker game could be the base game where a particular hand, such as four-of-a-kind is required to trigger operation of the bonus game. The bonus game however, although the same video poker game, would have a more favorable pay table offering a much higher hit rate. This could also be accomplished by the use of wild cards or other changes to the game rules.

It is also contemplated that the base game and bonus game could be executed on the reels of a spinning reel slot machine where the symbols on the reels are given two different sets of probabilities for the base and bonus games. Another alternative is for the two games to be very different, such as a spinning reel slot machine for the base game coupled with a video poker game as the bonus game. It is also contemplated, and disclosed herein as a first embodiment, to use a spinning reel slot machine as the base game and a video display type slot machine simulation as the bonus game. It is further contemplated, and disclosed herein as a second embodiment, to use a spinning reel slot machine as the base game, and a back-lit trail game as the bonus game. With reference to the programming and operation of processor controlled slot machines, the reader is directed to the disclosures in the following U.S. Pat. No. 4,095,795 to Saxton and U.S. Pat. No. 5,456,465 to Durham which are hereby incorporated by reference.

Figure 1:
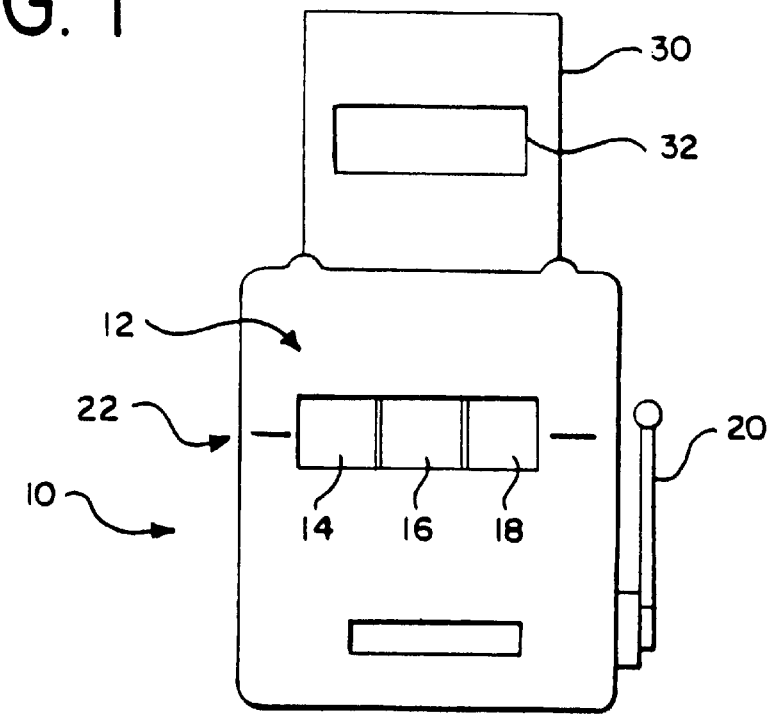
FIG. 1 is a simplified illustration of a spinning reel slot machine having a dot matrix display suitable for use with a bonus mode according to the present invention.
Figure 1A:
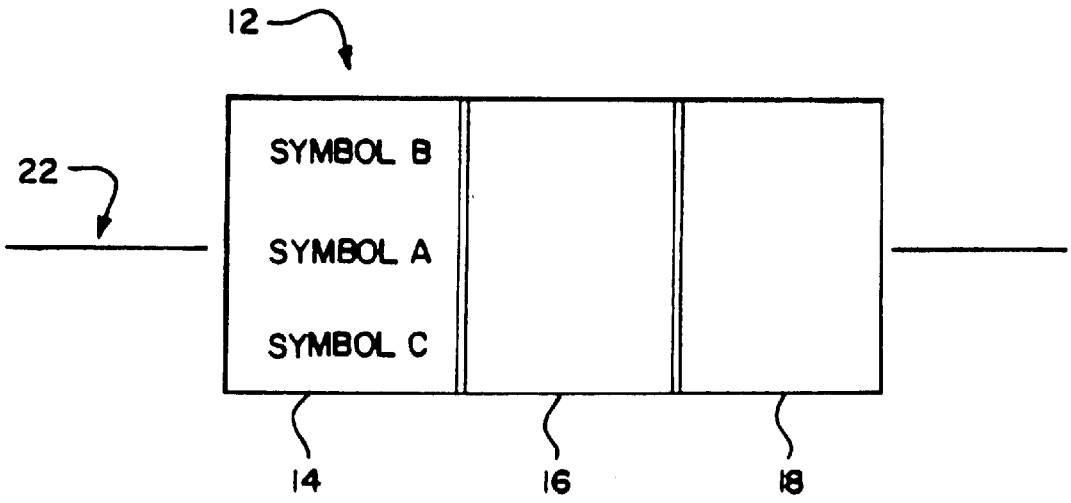
FIG. 1A is an enlargement of the slot machine display showing how symbols appear on, above and below the payline.

Referring to FIG. 1, there is shown a simplified diagram of a reel-type slot machine. The machine 10 includes a display window 12 through which a player may observe three spinning reels, 14, 16 and 18. Game play is initiated by inserting a coin or playing a credit and then pulling the lever 20 or operating a push button switch for the same purpose. A micro-processor then operates according to its game program randomly selecting a reel stop position for each of reels 14, 16 and 18. The reels are set in motion to give the player the feeling of randomness, but in due course the reels are stopped at the preselected stop positions using technology well known in this art which typically includes stepper motors for driving the reels and stopping them at the desired position under processor control. A payline 22 is located centrally of the display 12. Symbols which stop on the payline are evaluated to determine if a winning combination has occurred. If so, in a typical slot machine, a payout is made and the game is over. In some games the symbols above and below the payline are also visible in the display window. This provides additional excitement to the player. In some games, the ability to see the next symbol, above and below the payline, can be used to provide additional entertainment and payoff features. Thus, for example as shown in FIG. 1A, which is an enlargement of the display window 12, three symbols are visible on Reel 14. Symbol A is on the payline, while symbol B is above the payline and symbol C is below the payline. Specific embodiments of the present invention make use of this feature of traditional slot machines in a manner to be explained hereafter.

DESCRIPTION OF A FIRST EMBODIMENT

Returning to FIG. 1, according to a first embodiment of the invention, the slot machine 10 is provided with a video-type display 32 which may be a CRT or a dot matrix display, as desired. The display is housed in a vertically disposed enclosure secured to the upper portion of the slot machine 10. The display 32 is used for purposes of playing a bonus game. If the bonus game is a poker game for example, a poker hand would be shown on the display and the player paid if a winning hand occurs. Similarly, if the bonus game is a slot machine simulation, spinning symbols would be simulated on the display stopped in various combinations, some of which would constitute winners.

There will now be described a first embodiment of the invention, for implementing the invention in a commercial environment. It must be reiterated that this is only one such possibility A and that any combination of two suitable games that are percentaged and interoperable according to the present invention may be used. The basic game is played on the spinning reels of the slot machine 10, while the bonus game is played on the dot matrix display 32. The basic game has typical symbols such as Cherry, Single Bar, Double Bar and Triple Bar spaced on the reel strips 14, 16 and 18. Typically these symbols will be randomly displayed on the reel strips, usually separated by a blank, which is itself a symbol. In addition to these standard slot machine symbols, the reel strips also carry a bonus symbol, the selection of which leads to operation of the bonus game as will be described.

FIG. 2 is a table illustrating the reel strip symbol frequency for the base game of the first embodiment. The symbols which appear on Reel 1 include: the WinStreak or bonus symbol, the "special" WinStreak blanks on either side of the WinStreak bonus symbol, the 3Bar, 2Bar and 1Bar symbols plus regular blanks and cherries for a total of 22 symbols one at each of 22 reel stop positions. Reels 2 and 3 are similar. A typical symbol layout for this example is shown in FIG. 2*b*. The occurrence of the various symbols varies from reel to reel, but each reel has 22 symbols in all and therefore the odds of any possible combination of distinct symbols appearing on the payline is 1 in 10,648 (22×22×22). Thus, according to a first implementation of the invention, the base game may be a standard processor controlled spinning reel slot machine, augmented however, with bonus symbols and special blanks. It is substantially similar to the system described in U.S. Pat. No. 4,095,795 to Saxton, albeit a different software algorithm is employed for selecting the symbols.

As with most such games, the payout table is set so that the machine retains a percentage of the money played (the hold percentage). Calculation of the hold percentage of the machine however requires inclusion of the bonus game. For illustrative purposes, a typical pay schedule for the reel strips of FIG. 2 is shown in FIG. 2A. The schedule includes the calculated payouts for the bonus game as will be discussed hereafter. FIG. 2A also shows the probability of occurrence of winning combinations and the expected value (EV) from which the hold percentage is calculated. Thus for the reel strip of FIG. 2, the probability of 3 bars occurring is 0.000376 and since it pays 50 coins the EV is (50× 0.000376)=0.018783. By summing the EV's for all winning combinations, including the bonus game combinations represented in the schedule as "3WinStreak and "3AnyStreak", it can be determined that the illustrated embodiment has a payout percentage of 94.4045. That is, for every dollar played, on average, about 94 cents will be returned to the player and 6 cents will be retained as profit.

In the basic game when three bonus symbols appear in the display 12 (either on the payline or above or below the payline) the bonus game is initiated. If the three bonus symbols are on the payline, according to the described embodiment, the bonus game is initiated with all awards doubled. According to the first embodiment, the bonus game is implemented in a dot matrix video display shown at 32 in FIG. 1. This display is utilized by the processor to simulate a spinning reel slot machine. The symbols used in the bonus game are Cherry, Single Bar, Double Bar, Triple Bar, Blue 7 and Red 7. This is shown in the pay table of FIG. 3. As will be apparent in this example, some symbols appear in the bonus game which do not appear on the basic game reel strips. For simplicity, it is preferable, but not necessary that the bonus game and basic game use the same pay table for common symbols i.e., the same award for 1 or 2 Cherries, and for Any Bar, Single Bar, Double Bar and Triple Bar combinations. Typically posted on the outside of the machine is such a combined pay table including the awards for the 3 Cherries, Any 7, Blue 7 and Red 7 which are only available in the bonus game.

In the illustrated implementation, there are 22 reel stop positions on each of 3 reels of the basic game (See FIG. 2). The machine uses a probability of 1 in 22 for each reel stop position on each reel. The bonus symbols (WinStreak) appear two times (at two stop positions) on the 1st reel, three times on the 2nd reel and once on the 3rd reel. Thus, the probability of 3 WinStreak symbols on the payline has a probability of (2*3*1)/(22*22*22)=0.0005634861=A. This is equal to 1 in 1774.667 spins. Preferably, the multiple instances of the WinStreak symbol on reels 1 and 2 are placed at least 4 stop positions apart such as shown in FIG. 2B. As a result, the blanks above and below the WinStreak symbols will put a WinStreak bonus symbol within one position of the payline. This provides 3 times the number of reel stop positions as there are WinStreak Symbols which may trigger the bonus game. The probability of entering the bonus game is (6*9*3)/(22*22*22)=0.0152141247=B. In summary, a 2× multiplier bonus game (3 WinStreak symbols on the payline) will be achieved with a probability of A. The probability of a regular bonus round played with a 1× multiplier is B-A.

A principal feature of the invention is the high hit rate of the bonus game coupled with the spin-til-you-lose concept. The following discussion of the bonus game mathematics will focus on a single coin implementation. It is well known how to extend this to 2-coin, 3-coin, 5-coin or other versions allowing more than one coin to be wagered on each base game.

The expected return on a slot machine is computed by combining the probability of each award with the amount of the award as indicated in FIGS. 2 and 3. The expected value (EV) of each award is computed by taking the product of the probability of achieving the award and the number of coins awarded. The sum of each of these products results in the expected return of the slot machine. This result will be in the form of a fraction of 1 coin. The return of the combined game, (basic and bonus games) according to the invention is computed by using this method for each regular symbol combination of the base game, to which is added the expected value of the bonus game combinations. The expected value of the bonus game is computed by multiplying the probability of getting to the bonus game by the expected number of coins awarded in the bonus game. Call the expected value (EV) for coins won in the bonus game "C". The value "C" is formed from two entries. Entry 1 is the probability of playing the bonus round with a 1× multiplier B−A from the preceding discussion times the EV of the bonus game or ((B−A)*C). Entry 2 is the probability of playing the bonus round with a 2× multiplier (A), times the EV of the bonus game times two or (A*C*2). To obtain the value C requires additional information.

The expected value for each spin of the bonus game is computed in the same manner described above, computing the sum of expected values for each possible award. While any commercially successful slot machine must have an expected value of less than 1.00 this restriction does not apply to the bonus game per se. According to the present invention, as long as the value C, when inserted into the expected value equation for the entire game, results in a return for the entire game of less than 1.00, the expected value for the bonus game may be greater than 1.00. The expected coins per spin of the bonus game in the example is X coins. By computing S, the expected number of spins until a loss occurs in the bonus game, C is then computed as the product of this number of spins, times the coins expected per spin, X. That is C=S*X.

According to this embodiment of the invention, the bonus game has a hit rate greater than 50% and preferably greater than 70%. Assuming an 85% hit rate, for example, on each spin the probability of losing is approximately 0.15. The bonus game program is configured such that a player continues playing until he loses. One of ordinary skill in probability theory will recognize this mode of operation as a series of Bernoulli trials with p=0.15. That is, a succession of trials (spins) each with a 0.15 probability of "success". Note that the probability expressed in a Bernoulli trial is usually referred to as the "probability of success" of that trial, but as applied to the bonus game the "success" of a trial corresponds to losing the game (i.e. a non-winning spin). For more information on Bernoulli trials see, for example, Hogg and Tanis "Probability and Statistical Inference" 4ed. pp. 150–171, 1993 Prentice-Hall Inc.

Figure 6:
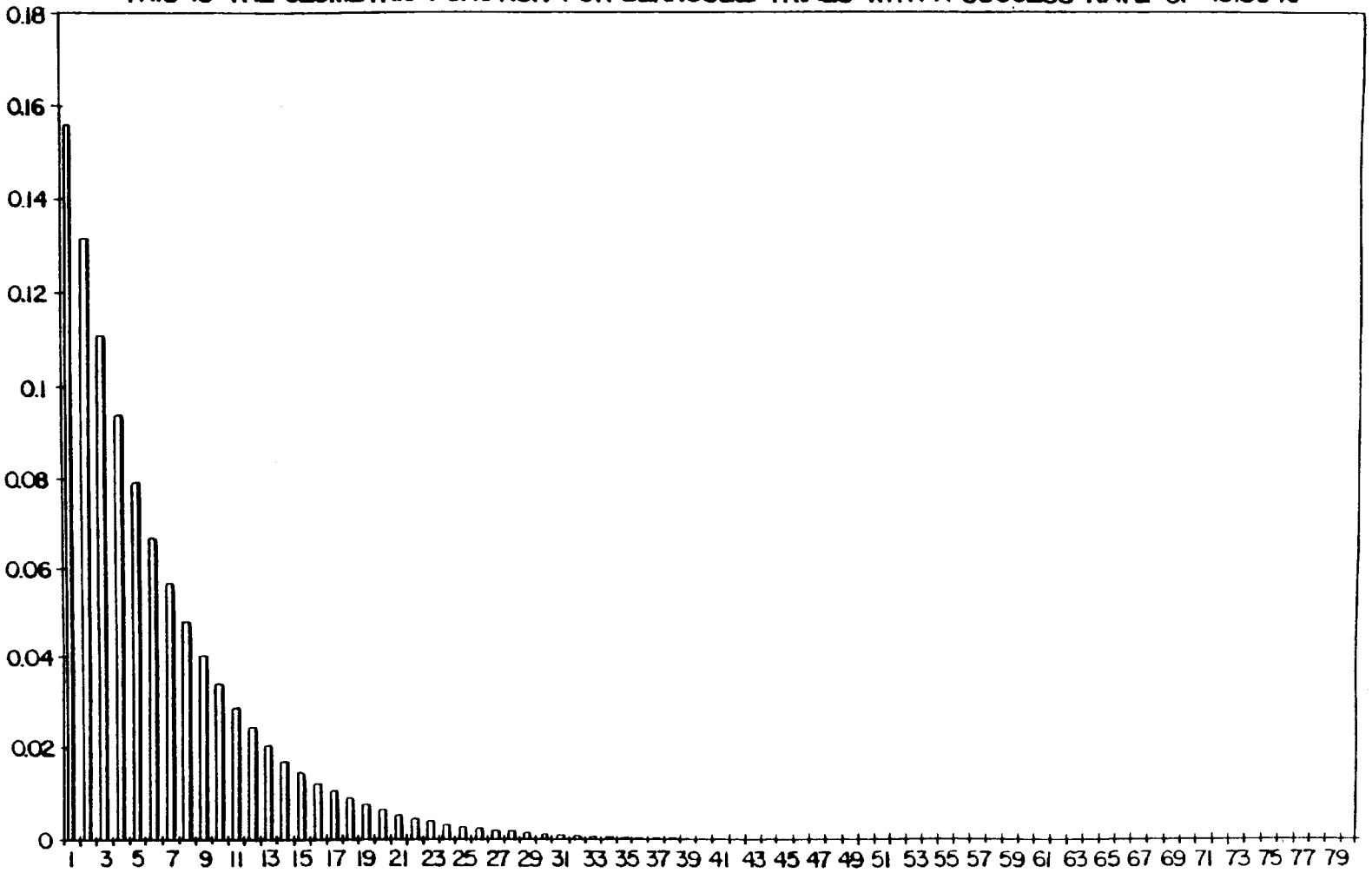
FIG. 6 is a graph of the Geometric function for Bernoulli trials according to an example of the invention.

The function that shows the probability of "trials until success" of a Bernoulli function (in this case the number of trials until we achieve the 0.15 probability loss) is called the Geometric function (see FIG. 6). This assumes p remains constant. As will be seen in the case of the second embodiment below, it is permissible for p to vary, but the expected trials until success is more difficult to compute. The probability of first success (loss on the bonus game after 1 trial) is 0.15. The probability of success (loss on the bonus game) after 2 trials is 0.85*0.15=0.1275. For three trials, the calculation is 0.85*0.85*0.15=0.108375 and so on. It is well known that the expected value (EV) of the Geometric function is 1/p where p is the probability of "success" on a given trial (i.e. loss on the bonus game). Therefore, S the expected number of spins of a bonus game with a hit rate of 85% is 1/0.15=6.667. Note this includes the final losing turn. The expected value (C) for this bonus game may be computed by multiplying the value of S (6.667) by the expected return per spin (X). That is C=S*X.

In practice, it is desirable to vary the payout percentages slightly. Accordingly, the bonus game may be modified to have either a different hit rate or a different average coins per spin value by adjusting the symbol probabilities stored in the computer program. FIG. 3 is an example of such an adjusted pay table. For the example of FIG. 3, the value X, the expected return per spin is 4.1751 (the sum of the EV column) while the hit rate is 84.41% producing a value of S 6.4145. Thus C=6.4145*4.175=26.781.

Referring to FIG. 2A the computed values C and 2C (for the 2× multiplier feature) appear in the pay column as the first two entries and are included in the EV column computations which sum to a 94.4045% hold. Thus the expected win for the bonus game is combined with the expected win of the base game to determine the expected value of the combined game. Note that the pay column uses a value of C=27.733 rather than 26.780. This is due to the use of the consolation feature described in connection with FIGS. 5 and 7.

From the foregoing, it will be understood that the first embodiment of the present invention provides a bonus game based on Bernoulli trials in which a player, who qualifies by playing the base game, can play the bonus game on a spin-til-you-lose basis. The bonus game according to this embodiment has a hit rate of greater than 50%, preferably higher than 70% As a result, the player has a strong inducement to "endure" the base game in order to qualify for bonus game play in which he is statistically likely of winning several times in a row and collecting relatively large payouts, while still returning a profit for the casino establishment.

By providing a two stage gaming process in which a traditional game of chance is played as the base game, the existing concept with which players are familiar and comfortable is retained.

At the same time, however, a significantly more exciting feature is added in the form of a bonus game. The software implementation of the invention, according to the described embodiment, is relatively straightforward and will be easily understood by those skilled in the art. As the specific programming is dependent upon the hardware employed, including the type of micro-processor selected, it is not useful to provide detailed software listings. For completeness, however, FIGS. 4 and 5 contain flow diagrams of the manner in which the base and bonus games are implemented in a processor based system. From these diagrams, those skilled in the art will be readily able to program the invention described herein.

Figure 4:
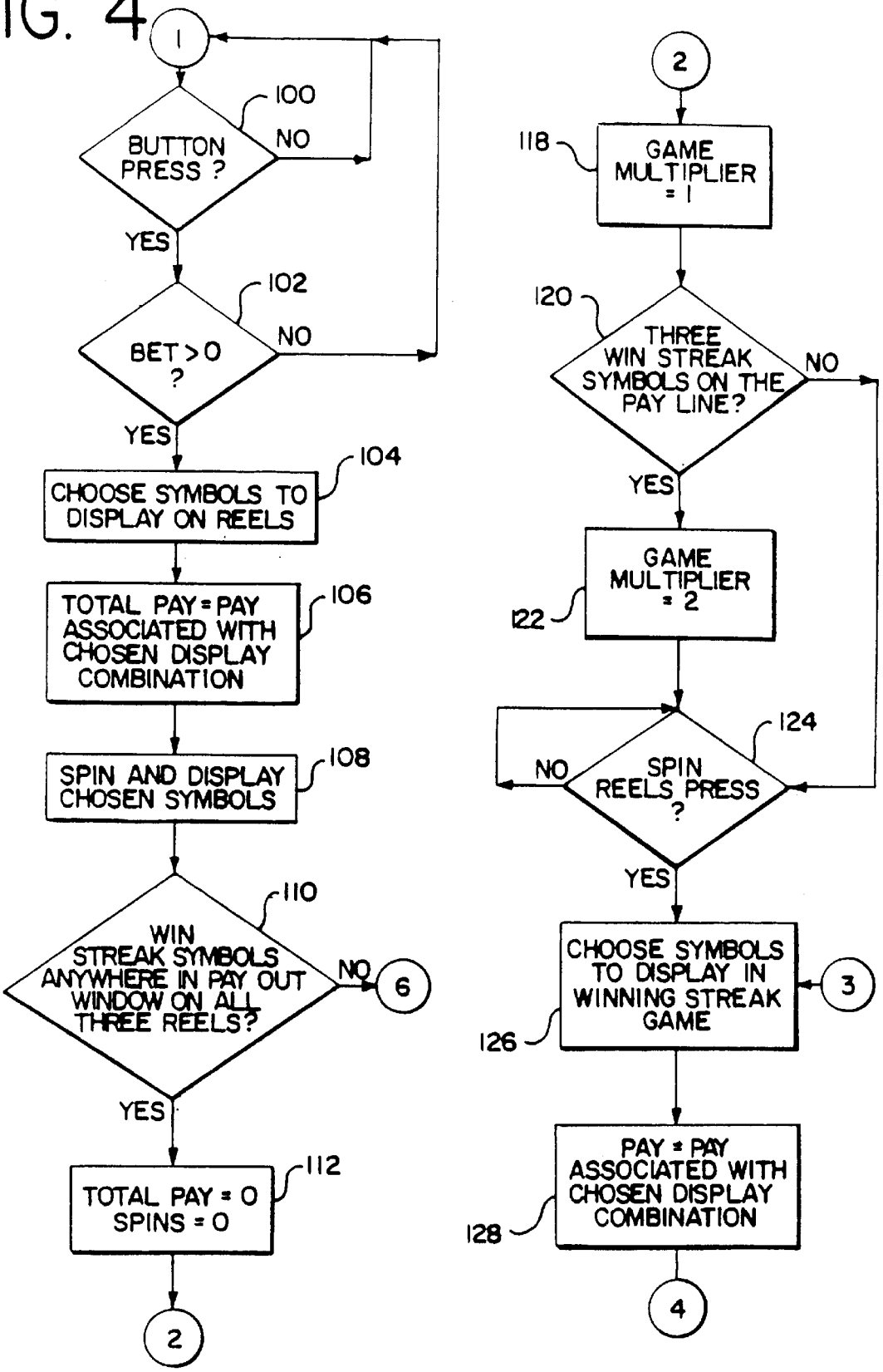
FIGS. 4 and 5 are software flow diagrams illustrating how the invention may be implemented.
Figure 5:
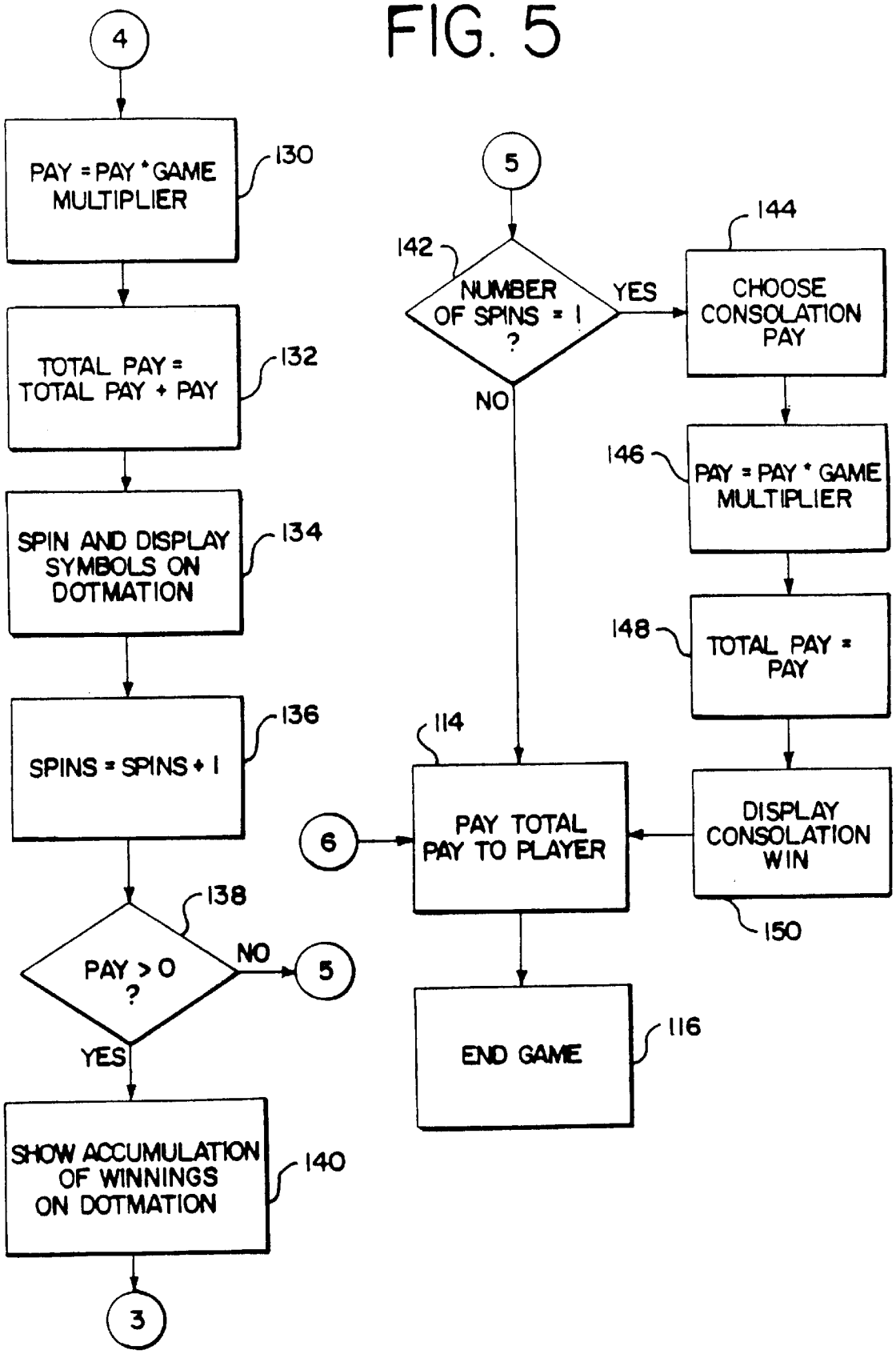

Referring to FIGS. 4 and 5, initially the processor waits until the player has pulled the handle or pressed a switch to initiate operation of the game. In addition, it is required that the player has placed a bet, i.e., that the amount wagered is greater than zero (Steps 100 and 102). The processor then uses any well known and accepted random number generator algorithm to choose the symbols for display on the reels of the base game (Step 104). A tentative value, Total Pay, is computed based upon a pay table (see, for example, FIG. 3*a*) for the selected symbol combination (Step 106). The reels 14, 16 and 18, in the case of the slot machine 10 of FIG. 1, are spun for a period of time and then stopped so that the symbols selected appear on the payline (Step 108). Before awarding credits to the player, in the event a winning combination appears on the payline, the program, according to the present invention, first checks to see if 1 WinStreak symbol appears on each reel (Step 110). If so, a bonus game has been earned and the program branches to Step 112 setting the Total Pay value to zero and the spin count to zero in preparation for initiating operation of the bonus game. If WinStreak symbols do not appear on each reel, either on the payline or above or below the payline, then the program branches to the circle labeled 6 in FIG. 5 where the tentative total pay computed in Step 106 is paid or credited to the player (Step 114) and the game ends (Step 116). As thus far described, this is the operation of a standard slot machine because the bonus feature was not invoked. The player must continue playing the game as described until a WinStreak symbol appears on each reel within the pay window to initiate operation of the bonus game.

When that occurs, the program, at Step 112, branches to the bonus game indicated on FIG. 4 beginning at the circle labeled 2. At Step 118 the bonus game multiplier is set equal to one. The program then checks, at Step 120, to determine if the three WinStreak symbols are on the payline. If so, the game multiplier is reset to two (Step 122). In either case, the program then proceeds to wait for the player to initiate operation of the bonus game by pressing a button or pulling a lever at Step 124. This initiates operation of the bonus game display, which in the illustrated embodiment, is played on the dot matrix display 32 of FIG. 1. The processor again uses its random number algorithm to choose the symbols to be displayed for the bonus game (Step 126). A value "Pay" is set equal to the number of coins associated with the chosen display combination at Step 128 and the program continues as shown in FIG. 5 in the circle numbered 4. The Pay value is multiplied by the game multiplier (Step 130) as a function of the outcome of the decision box 120. A cumulative value, Total Pay, is computed as being equal to the previous Total Pays plus the current Pay (Step 132). The program next goes through the process of providing an animation of spinning reels on the dot matrix display and as the reels appear to stop, the selected symbols appear (Step 134). The spin value is then incremented (Step 136) in preparation for the next cycle of the bonus game. Before commencing the next cycle, however, it is determined at Step 138 if the player has won or lost. If he has won, the accumulated winnings are displayed to the player at 140 and the next cycle of the bonus round commences by branching back to FIG. 4 beginning at the circle labeled 3.

If, however, it is determined at Step 138 that the player has lost, the program branches to the circle labeled 5. The program then determines whether the value of the spin counter is equal to one, indicating that the player lost on his first turn in the bonus round (Step 142). If so, according to a first embodiment of the invention, a consolation award is given. The program chooses a consolation pay amount (Step 144) using a random selection algorithm based, for example, on the second chance table illustrated in FIG. 7. FIG. 7 tabulates the possible pays as a consolation amount to a player who has achieved the bonus round but lost on the first spin. The random selection includes amounts of from three to fifty coins to be paid to the player. FIG. 7 illustrates for each of the possible pay selections, the number of such selections among a schedule of 100 memory locations. Thus there are 32 pays of 3 coins, 45 pays of 5, 20 pays of 10, 2 pays of 20, and but one pay of 50 coins. The expected value for this additional payout is provided in the fourth column of FIG. 7 as 6.11 coins. Since the probability of losing on the first spin is 0.1559 this adds an expected value to the overall game of 0.952536 as illustrated in FIG. 7 and this is added to the expected win value shown in FIG. 3 as 26.78072 to obtain the overall payout shown in FIG. 2*a* of 27.73326.

After the processor chooses a consolation pay amount, the chosen pay amount is multiplied by the game multiplier (either one or two) and the total pay is set equal to the multiplied pay amount (Steps 146, 148). Finally, the amount of the consolation win is displayed, Step 150, and then payment is made at Step 114.

If the bonus round loss occurs after the first spin, the program goes from Step 142 to Step 114 where the player is credited with the Total Pay won to that point and the game ends at Step 116.

In summary, the first embodiment plays a basic game on a reel type spinning slot machine 15. and a bonus game on a dot matrix display which may be another type of game or a simulation of a reel type slot machine. As shown in FIGS. 4 and 5, the basic game and bonus game operate in a similar manner in a first embodiment. With respect to the bonus game, however, a first Bernoulli trial commences. Symbols are selected for display, a simulated reel spinning animation, poker display etc. is provided and then the simulation stops to show the player the selected symbols. If the combination on the payline or the poker hand is a winner, the number of coins determined by the pay table is credited to the player's account. Then a further Bernoulli trial or operation of the game occurs. This continues as long as each trial produces a winning combination. In this manner, the player can quickly accumulate a significant bonus since the hit rate for the bonus game is desirably greater than 50% and preferably greater than 70%. For a typical game (i.e. hit rate approximately equal to 85%) designed according to the invention, it will take between 5 and 6 Bernoulli trails before a losing combination occurs in the bonus game, providing the player with a large bonus and a great deal of excitement as he watches his winnings mount. When, at last, a losing trial occurs, the game is over (unless a loss occurs on the first trial and the optional consolation or second chance feature is employed). It should be noted that the Geometric function has a non zero probability for any number of trials. That is, on occasion 10, 20, 50, 100 or more successive wins in a row are possible. However, a limit is normally put on the number of allowable coins accumulated in case equipment malfunction results in an unbounded run of wins. For example, a limit of 4 times the maximum standard award value could be set, i.e. 6,000 coins in this example. Such a large payout is incredibly unlikely to happen by chance, and thus limiting the payout in this way will probably never be noticed unless equipment malfunction occurs.

DESCRIPTION OF A SECOND EMBODIMENT

A second embodiment of the invention features a bonus game with a trail type board game and is described hereinafter with reference to FIG. 8, which shows a machine in accordance with this embodiment. When the bonus mode is entered, a random number is selected by a random number generator in the slot machine 10. This random number is used to select a movement value on the trail type board game. The position of the player's token or symbol for the trail game is moved according to the movement value, and an action, such as a payout of coins is performed, depending on the characteristics of the stop position on the trail game. Further random numbers are generated and moves are made along the trail game independently of the base game. Any coins won are added to a total payout from the bonus game, and do not replace winnings from previous locations on the board. Further moves are made until a losing location on the trail game is reached. Thus, the second embodiment of the invention provides a spin-til-you-lose game comprising a series of trials, but the probability of winning on any particular trial is a function of the location on the board.

Figure 8:
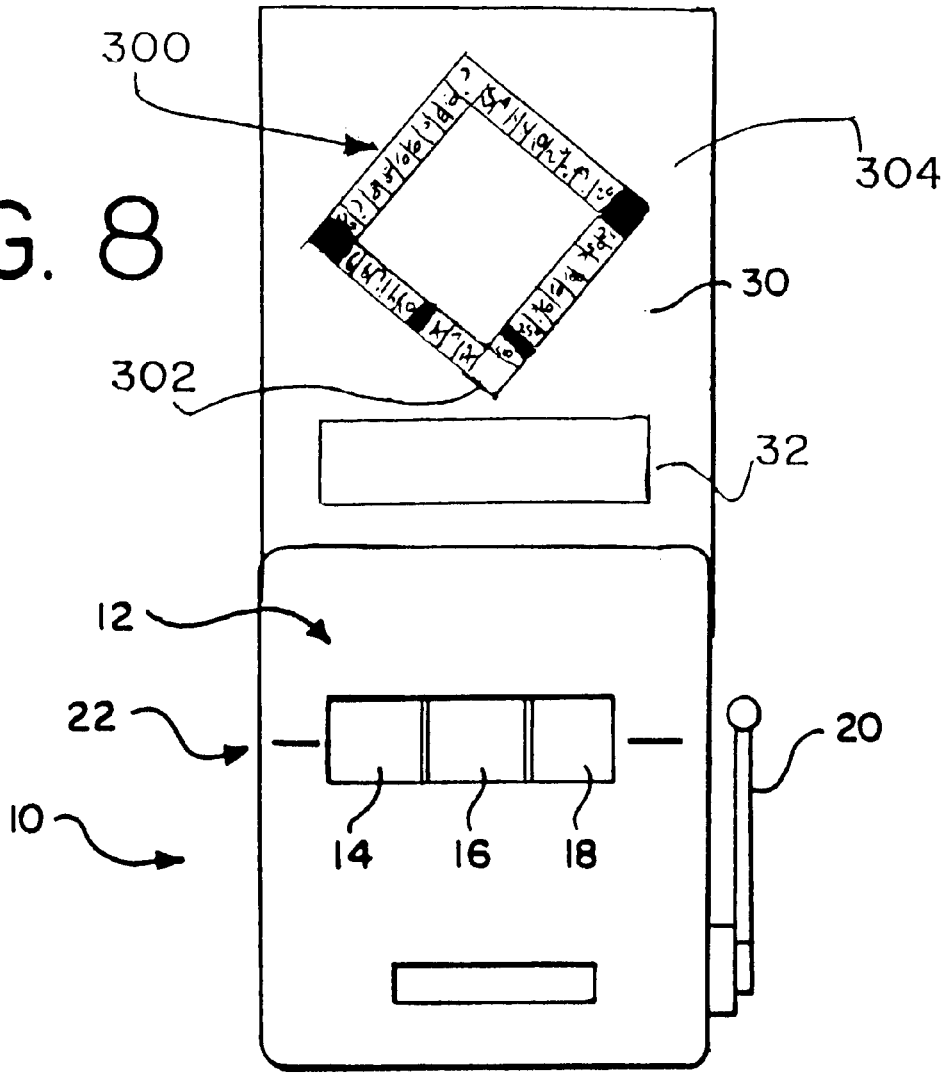
FIG. 8 shows a spinning reel slot machine according to a second embodiment of the invention.

With reference to FIG. 8, as in the first embodiment, the slot machine 10 is provided with a video-type display 32 which may be a CRT or a dot matrix display, as desired. A back lit trail board display 300, allowing each individual position on the trail to be illuminated independently is also provided, and the two displays 32 and 300 are used in conjunction for playing a bonus game. Both displays are housed in a vertically disposed enclosure 30 secured to the upper portion of the slot machine 10.

The specific example of the second embodiment is also provided with three reels and has symbols on each of reel strips 14, 16 and 18. These symbols are located at 24 positions and consist of the symbols CHERRY, SINGLE BAR, DOUBLE BAR, TRIPLE BAR, RANDOM, WILD and SEVEN spaced on the reel strips 14, 16 and 18. Typically, the symbols will be randomly displayed on the reel strips, usually separated by a blank, which is itself a symbol. Several of these blank locations actually represent a secret "SURPRISE" symbol discussed hereinafter. In addition to these standard slot machine symbols, selected symbols also have a bonus symbol superposed, the selection of which on all three reels leads to operation of the bonus game as will be described. An example of a set of reel strips is shown in FIG. 9. The symbols marked with a "/R" also have the bonus symbol superposed. The symbols (BLANK/A) and (BLANK/B), which are in positions above and below symbols marked as bonus symbols act as blank symbols, but are stored differently from blank symbols in memory. Using these extra symbols stored in memory, only the payline symbol needs to be monitored at the end of each spin, to establish if symbols marked as bonus symbols are in the three positions on each reel in the displayed window shown in FIG. 2. It should be noted that in this example of the second embodiment, when three bonus symbols appear in the window shown in FIG. 2, leading to activation of the bonus game, no winning combination of the standard symbols can occur. As will be seen, this means that the bonus game can only occur when no other winning combination occurs, so the bonus payout never needs to be combined with the payout from the main game. This is advantageous, as it simplifies calculation of the bonus payout feature, and keeps the payout associated with the bonus game in a predetermined range. However, alternative embodiments are envisaged in which bonus games can be initiated in combination with a standard winning combination in the base game, the bonus game payout multiplying, supplementing or otherwise combining with the payout from the base game.

FIG. 10 is a table illustrating the reel strip symbol frequency for the base game of the second embodiment, using the symbols of FIG. 9. The total reel strip frequency, shown in the column headed "occur" on each reel is 24, corresponding to the 24 symbols, one at each of the 24 reel stop positions. The occurrence of the various symbols varies from reel to reel, but each reel has 24 symbols in all and therefore the odds of any possible combination of distinct symbols appearing on the payline is 1 in 13,824 (24×24×24).

FIG. 11 is a table showing the payout value in the "Pays" column for each winning reel strip combination. The number of occurences of each of the symbols contributing to each win is also shown in the "#/Reel x" columns, and the product of these occurences in the "Hits" column. This value is the number of times the selected payout is likely to occur every 13,824 games.

A pay schedule for the reel strips shown in FIG. 9 and the rules shown in FIG. 11 is shown in FIG. 12. As with the first embodiment, calculation of the hold percentage of the machine requires inclusion of the bonus game. The schedule includes the calculated payouts in the 4 coin mode for the bonus game as will be discussed hereafter. FIG. 12 also shows in the "1–3 coin prob" and "4cn prob" columns the probability of occurrence of winning combinations and the expected value (EV) in each mode from which the hold percentage is calculated. For example, for the reel strip of FIG. 9, the probability of 3 1-bars occurring is 0.009042 and since it pays 20 coins in the two-coin mode, the EV is (20×0.009042/2)=0.09042. By summing the EV's for all winning combinations, including the bonus game combinations represented in the schedule as "Bonus" and "Surprise", it can be determined that the illustrated embodiment has hold percentages of 91.2%, 91.2%, 92.2% and 95.0% in the 1-coin, 2-coin, 3-coin and 4-coin modes respectively. That is, for every dollar played in the 4-coin mode, on average, about 95 cents will be returned to the player and 5 cents will be retained as profit.

In the 4-coin mode basic game, when three bonus symbols appear in the display 12 either on the payline or above or below the payline (represented by /R, /A and /B for the bonus symbol being on, above or below the payline respectively in the table of FIG. 10) the bonus game is initiated. As an extra novelty, the bonus game is also initiated in 4-coin mode when certain predetermined SURPRISE blank symbols stop on the payline. According to this embodiment, the bonus game is implemented both in the dot matrix video display shown at 32 in FIG. 8, and on the trail-type board shown at 300.

The first position 302 on the trail board 300 is illuminated using a light behind the board on entry to the bonus game. An award of 5 coins is awarded to the player for reaching the bonus game, and shown in a winnings portion of the dot matrix display. This ensures that the player does not leave the bonus game without winning anything at all.

An animation is shown on the dot matrix display, and a movement value M is generated, representing the distance of movement along the trail board. In a standard implementation, this value M will be represented by the rolling of a pair of dice, and the values generated on this display accordingly range from 2 to 12. The probability of selecting each value need not be the same, and furthermore need not be the same as the actual probabilities of rolling a particular value with a standard pair of dice. Indeed in this example of the second embodiment, each position on the board has its own set of probabilities for the results of a dice throw from that position. Two sets of probabilities from the first and second position for this specific example of the second embodiment are shown in FIG. 13 for reference. Using the first table, one of 114 values is selected with equal probability. Each of these values is mapped onto a movement values from 2 to 12 in proportions shown in the "occur" column. The probability of selecting any particular value (shown in the prob column) is the value in the occur column divided by 114. Accordingly, a higher likelihood can be provided for the player arriving at certain predefined positions than other positions, whereby to enhance player excitement. The dot matrix video display is utilized by the processor to show animations representing the generation of the movement value, such as an animation representing rolling the pair of dice. Clearly, other means of generating and displaying values could be implemented. Once the program animation has shown the generated value, positions on the trail board are lit sequentially to represent advancing along the board the appropriate number of spaces. Once a position is reached, a variety of different outcomes can occur, depending predominantly on the position that has been reached on the board. A particular position will generally be either a winning position or a losing position such as 304 (shown shaded in FIG. 8). If a winning position is reached, an award value will generally be added to the winnings. An animation is shown to represent the payment of the award, and the random number generation cycle starts again. Examples of expected winnings for the 40 positions in the game are shown in FIG. 14. The value "END" means that the position is a losing position and no award is given. If a losing position is reached, an animation is shown on the dot matrix display to represent losing the game, and the bonus game ends. The total amount won in the bonus game is added to the amount won in the base game. It should be noted that the latter will always be zero in this embodiment if the bonus game has been activated, as discussed above. The award is either paid out or stored, as in a standard spinning reel slot machine.

Certain positions might have other outcomes associated with them, involving animations shown on the dot matrix display. For example, if position 3 is reached, a further random number is generated by the processor, as shown in FIG. 15. In this case, this random number has 103 alternative values. With 52 of these values, awards varying from 5 to 50 are given and added to the winnings. The other 51 values result in movement of the play position to either position 11 or position 41. It can be seen that the expected payout for this position, being the sum of the EV column is 4.37. If an award is given, a standard movement table as described above with reference to FIG. 13, and also shown in FIG. 15 for position 3, is used to determine the position moved to on the next "dice roll". Other positions have similar variable payout values calculated in a similar manner, or payout values which vary depending on how many circuits of the board have occurred.

The expected payout of the bonus game must be calculated in order to calculate the overall payout of the machine. The simplest way of calculating the expected payout of the bonus game is to establish all the positions i which can be reached on the board. If the board forms a loop, as it does in this specific example, the same physical position on the board should be treated as a different position for the purposes of this analysis for each circuit of the board, even if the outcomes associated with that position are the same on each circuit of the board. That is to say, the looped board should be treated as if it were unraveled into one long trail, with the outcomes associated with the positions on the trail repeating cyclically. For example, the first position on the physical board after the start position cannot be reached on the first circuit of the board, as it is impossible to roll a value of 1 with two dice. However, it is possible to reach this position on the second circuit of the board. Furthermore, according to the specific example of the present invention, in which the number of circuits of the board is limited, it is impossible to reach any but the first 12 positions on the board after the last circuit of the board unless play is directed to one of the other positions by a special feature in a position that is reached. (Play would then stop once that position is reached). Expanding the board into a trail allows these differences to be taken into account.

The expected payout can be calculated simply as the sum of the product of the probability prob(i) of reaching each position i on the board and the expected payout pay(i) at that position, ie.

$$\sum_{i=first\ position}^{last\ position} prob(i) \cdot pay(i)$$

The probability prob(i) of reaching a specific position i on the board is calculated as follows:

$$prob(i) = \sum_{j=first\ position}^{last\ position} prob(j) \cdot probmove(i, j)$$

Figure 16:
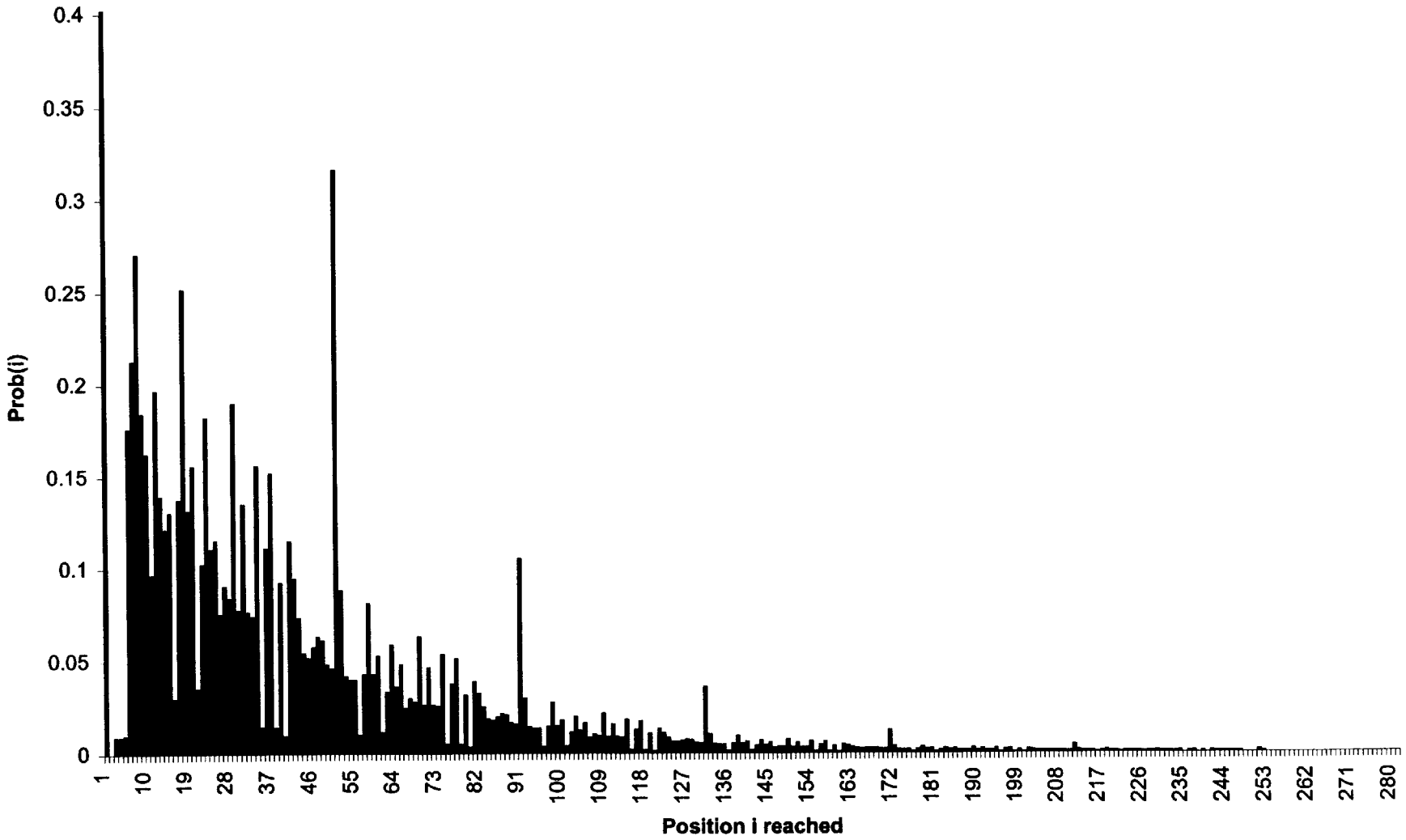
FIG. 16 is a graph showing the probability of reaching all the positions on the game board of the specific example of the second embodiment.

The function prob(i) for reaching a particular position according to the specific example of the present invention is shown in FIG. 16. It should be noted that prob(1)=1, as play is guaranteed to reach the start position once the game is commenced. However, the scale on the graph only goes up to 0.4 in order to show the other values more clearly.

It should also be noted that if an outcome at a later position on the board can move play back to an earlier position, and play could then move from there to the later position again, this equation could become circular. That is to say, a value prob(i) could be dependent on a value probe) which might itself be dependent on prob(i). The fact that a position might be reached more than once cannot be taken into account by the above equation, and a precise calculation of the expected payout then becomes very complicated. However, the situation can easily be avoided by either not allowing backward moving outcomes, or guaranteeing that all backward moving outcomes result in a losing outcome, so that cycling backward and forward movement cannot occur. Allowing such cyclical movement is also dangerous because a software or hardware error could lead to unbounded cycling and a corresponding unbounded payout.

Once the expected payout of the bonus game has been calculated, the expected payout of the main game can be calculated by incorporating this value in the equations. In the present invention, the expected payout of the bonus game is 106.53.

As in the first embodiment, in practice, it is desirable to vary the payout percentages slightly. Accordingly, the bonus game may have any of the values probmove(i,j) varied slightly to make it more or less likely to move to high scoring or low scoring positions, or the outcomes associated with each position could be varied. In practice, this is harder to do, as the outcomes associated with most of the positions will often be physically marked on the surface of the board. However, the probabilities of the different outcomes when more than one outcome is possible can be changed.

Referring to FIG. 12, the computed value for the bonus game appears in the pay column and is included in the EV column computations which sums to a 95.0% hold in the 4-coin mode. Thus the expected win for the bonus game is combined with the expected win of the base game to determine the expected value of the combined game.

From the foregoing, it will be understood that the second embodiment of the present invention provides a bonus game based on variable probability trials, in that a player who qualifies by playing the base game can play the bonus game on a spin-til-you-lose basis, with the probability of each allowable outcome of each trial being variable, and in that the player is not in danger of losing awards scored in earlier trials when a losing outcome occurs, but instead accumulates winnings along the way. The bonus game according to this embodiment generally has a high hit rate, and as a result, the player has a strong inducement to "endure" the base game in order to qualify for bonus game play in which he is statistically likely to win several times in a row and collecting relatively large payouts, while still returning a profit for the casino establishment.

By providing a two stage gaming process in which a traditional game of chance is played as the base game, the existing concept with which players are familiar and comfortable is retained. At the same time, however, a significantly more exciting feature is added in the form of a bonus game.

A further feature of the second embodiment of the invention is that an alternative bonus game is commenced when a special wild symbol appears on the payline in a winning combination. According to the specific example of the invention, the special symbol is the "RANDOM" symbol discussed above. The alternative bonus game is played entirely on the dot matrix display, and involves the generation of a randomly selected result which is either added to the winnings for the winning combination obtained in the base game, or by which the winnings for the combination in the base game are multiplied. Clearly, as the amount can be added to the winnings or the winnings can be multiplied by the amount, there is no constant "expected value" produced by the alternative bonus game by which the winnings are multiplied. Thus, the expected payout for each different winning combination of which the "RANDOM" symbol can form a part need to be calculated separately. When a winning combination involving the "RANDOM" symbol occurs, the payout value for that winning combination is modified using a "RANDOM" payout modifier table selected from a set of 14 different "Random" payout modifier tables. A probability table for selecting a "RANDOM" payout modifier table is shown in FIG. 17, the probabilities of selecting a particular payout modifier table being weighted by assigning more random values to some tables than others, as has already been described. Once the payout modifier table has been selected, an entry in the payout modifier table is randomly selected, using a similar weighting technique. An example of a payout table is shown in FIG. 18. To calculate the actual expected payout for a particular "RANDOM" win, the probabilities of obtaining each of the possible outcomes from the "RANDOM" payout tables need to be calculated. This is easily accomplished by multiplying the probability of selecting each payout table by the probability of selecting a particular payout in that table, and summing the probabilities for each identical payout modifier. The probability of selecting each payout table is the number of occurrences of that payout table in the table shown in FIG. 17, divided by the total occurences of all the payout tables in FIG. 17 (in this case 17). Likewise, the probability of selecting a particular payout value in a payout table is the total number of occurrences of that payout value in the payout table divided by the total occurrences of all the payout values in the payout table (10 in the table shown in FIG. 18). This gives a table as shown in FIG. 19. Using this table and the base win for any particular winning combination, the expected payout is easily calculated. For example, the base pay for a SEVEN/RANDOM/SEVEN winning combination in one coin mode is 70. FIG. 20 shows how the expected payout of 194.2 shown in FIG. 12 for this combination is obtained. The selected payout modifier is shown in an animation on the dot matrix display, and the actual award is then shown, and subsequently paid out as described above. This extra bonus game does not form part of the invention, but is mentioned for completeness.

As in the first embodiment, it is not useful to provide detailed software listings. For completeness, however, FIGS. 21 and 22 contain a flow diagram of the manner in which the base and bonus games are implemented in a processor based system. From these diagrams, those skilled in the art will be readily able to program the invention described herein.

The game operates in the same way as the first embodiment until step 208. Before awarding credits to the player, in the event a winning combination appears on the payline, the program first checks to see if a "RANDOM" symbol appears on the payline. If it does, the program plays an animation on the dot matrix display, as shown in step 212 and generates a random modification to the payout, either adding to it or multiplying it. If the game is in 4-coin mode, the program checks to see if a bonus symbol appears on each reel (Step 216) in the positions on, above or below the payline, or if "SURPRISE" symbols appear on the payline on each reel. If so, a bonus game has been earned and the program enters the bonus game (Step 218), as discussed below with reference to FIG. 22. The program then pays out the total pay, if any, in step 220, thus ending the play. As thus far described, with the exception of the RANDOM feature, this is the operation of a standard slot machine because the bonus feature has not been described. The player must continue playing the game as described until a BONUS symbol appears on each reel within the pay window or the SURPRISE symbol stops on the centerline on each reel to initiate operation of the bonus game.

When the bonus game occurs, the program, at Step 216, branches to the bonus game shown in FIG. 22. The start position on the backlit trail game board is lit up, and the winnings for the bonus game are set to an initial value of five. A random movement value between 2 and 12, M is generated by the program, as shown in step 224 and an associated animation is shown on the dot matrix display to indicate the value M selected. The position indicator is moved M places. If the position reached is a losing position, a losing animation is shown in the dot matrix display, and the total winnings are transferred to the total pay to be either paid out or stored as credits. If the position is not a losing position, the program executes a routine associated with the position. This subroutine might be a variable outcome generating position, in which case a random value is generated to decide what the outcome associated with the position will be. The outcome will consist either of a "payout" or a "move". In the former case, the payout is added to the bonus game winnings, along with a suitable animation on the dot matrix display, and assuming the player has not completed the maximum number of allowable circuits of the board, the program loops back to generate another movement value M. If the player has traveled around the board the maximum number of times, the winnings are transferred to the total pay, as when the player lands on a losing position, and the bonus game ends. If the outcome is a "move" outcome, play is moved in a forward direction to the position indicated (unless the indicated position is a losing position in which case play can be moved backwards). Play then continues in the same way as if that position had been reached from step 226.

In summary, the second embodiment plays a basic game on a reel type spinning slot machine and a bonus game on a dot matrix display and backlit trail board. When the Bonus game is entered, a first variable probability trial commences. A distance to move on the trail game board is selected. The player is moved to that position on the board, and the outcome associated with that position occurs. This outcome might consist of the ending of the game, the paying out of an award, or further movement to another location on the trail board. If the position on the board was not a losing position, a further trial cycle of the game occurs. This continues as long as the player does not land on a losing position, or a predefined end position on the board is reached. The awards associated with all the preceding winning trials are then paid out. In this manner, the player can quickly accumulate a significant bonus since the survival rate for the bonus game is generally significantly greater than 50%. For a typical game, it will take several trials before a losing combination occurs in the bonus game, providing the player with a large bonus and a great deal of excitement as he watches his winnings mount. When, at last, the player reaches a losing position, the game is over (unless a loss occurs on the first trial and the optional consolation or second "RANDOM" feature is employed). It should be noted that the probability of survival is non-zero at all times, as it is always possible to move to a non-losing position. That is, on occasion 10, 20, 50, 100 or more successive wins in a row are possible. However, a limit is put on the number of successive wins allowable in case of equipment failure. This can easily be accomplished by limiting the length of the trail in the trail game, or limiting the number of times the player can move around the looped trail if the board is a closed loop.

There have been various spinning reel slot machine models that include a feature that will cause the machine to repeatedly spin the reels until a winning combination appears. Examples of such machines are WMS Gaming's "Jackpot Stampede" and IGT's "Spin 'til you win". These models have some added appeal but the shortcoming is that the player's expectation is crushed once he or she realizes that there is a high likelihood that the first winning combination to hit will be one of the "small" awards (e.g. one cherry). There have also been variable spinning reel slot machines with trail bonus games, such as Williams Electronics Games, Inc.'s "Phantom House", which allow play to proceed until a losing situation occurs. However, these games differ from the second embodiment of the present invention in that the player can choose at the end of each move whether or not to collect the winnings associated with that position only, or to gamble continuing with the game. If a losing situation then occurs, the player wins nothing. This is fundamentally different from the Trial concept both in that winnings in the bonus game are accumulated and in that accumulated winnings cannot be lost. It is believed that no one has heretofore designed a game according to the present invention that provides variable probability trials that continue until a losing outcome occurs without returning to the base game, collecting all wins along the way.

The present invention provides a high hit rate bonus game, so the player's winnings add up quickly. As the successive trials "fail" (thus extending the game) the player is winning more and more money. As FIG. 16 shows the probability of the number of spins is asymptotic to zero. This means that there is a non-zero probability for each spin count and the bonus game will, on occasion run through a tremendous number of spins accumulating large rewards, something that has never been offered before. The joining of a high hit rate bonus game to a traditional base game is the key to the excitement of this feature.

While preferred embodiments of the present invention have been illustrated and described, it will be understood by those of ordinary skill in the art that changes and modifications can be made without departure from the invention in its broader aspects. Various features of the present invention are set forth in the following claims.

What is claimed is:

1. A processor controlled game of chance comprising:

a) a processor, operating according to a game program, for randomly selecting symbols and for awarding credits when winning symbol combinations are selected;

b) display means on which said selected symbol combinations are displayed to a game player;

c) said processor operating in a basic mode unless and until a bonus symbol combination is selected, said processor, in said basic mode, selecting symbols and awarding credits or money in response to the input of money or credits by said player;

d) said processor operating in a bonus mode after said bonus symbol combination is selected; said processor, in said bonus mode: (1) selecting an outcome as the result of a trial having a first probability of a winning outcome; (2) displaying the outcome on a display; (3) adding credits to a bonus mode total if said outcome is a winning outcome; (4) repeating steps d(1) to d(3) accumulating credits for each winning outcome using the same or a different probability of a winning outcome, until a losing outcome occurs wherein the bonus mode is ended and credits accumulated in earlier trials are not lost;

whereby a player who reaches the bonus mode accumulates credits as a function of the number of trials survived.

2. A processor controlled game of chance in accordance with claim 1 wherein the probability of selecting a non-losing outcome is a variable probability and is greater than 50% for some trials.

3. A processor controlled game of chance in accordance with claim 1 wherein said bonus mode comprises a trail game; and wherein said step of selecting an outcome as the result of a trial comprises selecting a random movement value to reach a position on said trail and selecting an outcome from at least one alternative allowable outcomes associated with said position.

4. The processor controlled game of chance of claim 1 wherein the display means includes at least two physical reels having symbols arranged thereon, the selected symbols being displayed to a player by rotation of said reels.

5. The processor controlled game of chance of claim 1 wherein said processor is programmed to produce an expected value (EV) for said bonus mode greater than 1.0 but wherein the EV of the combined basic and bonus modes is less than 1.0.

6. A processor controlled game of chance in accordance with claim 1 wherein the bonus game is ended if the number of trials exceeds a predetermined maximum.

7. A processor controlled game of chance in accordance with claim 1 wherein the bonus game is ended if the accumulated winnings exceeds a predetermined maximum.

8. In a gaming machine including processor means for randomly selecting outcomes, some of which are winners and the remainder being losers; and for awarding credits or money corresponding to said winners, and display means for displaying the selected outcomes the improvement comprising:

a) said processor means being programmed to designate certain outcomes as a bonus event permitting the play of a bonus game;

b) said processor means being programmed to provide a plurality of trials during bonus game play, said processor iteratively and randomly selecting outcomes, each of which is the result of a trial wherein the probability of success may vary between trials;

c) displaying said outcomes and awarding the credits after each winning outcome wherein credits are accumulated for each winning outcome until a losing outcome is selected wherein the bonus game is ended and credits accumulated in earlier trials are not lost;

whereby a player who reaches the bonus game accumulates credits as a function of the number of variable probability trials survived.

9. A processor controlled game of chance comprising:

a) a processor, operating according to a game program, for randomly selecting symbols and for awarding credits when winning symbol combinations are selected;

b) display means on which said selected symbol combinations are displayed to a game player;

c) said processor operating in a basic mode unless and until a bonus symbol combination is selected, said processor, in said basic mode, selecting symbols and awarding credits or money in response to the input of money or credits by said player;

d) said processor operating in a bonus mode after said bonus symbol combination is selected; said processor, in said bonus mode: (1) selecting an outcome as the result of a variable probability trial; (2) displaying the outcome on a display; (3) adding an award to a bonus game award total if said outcome is an award paying outcome; (4) repeating steps d1 to d3 accumulating credits for each award paying outcome until a losing outcome occurs wherein the bonus mode is ended and credits are not lost; (5) paying out said bonus game award total;

whereby a player who reaches the bonus mode accumulates credits as a function of the number of variable probability trials survived.

10. A processor controlled game of chance in accordance with claim 9 wherein the bonus game is ended if the number of trials exceeds a predetermined maximum.

11. A processor controlled game of chance in accordance with claim 9 wherein the bonus game is ended if the accumulated winnings exceeds a predetermined maximum.

12. A processor controlled game of chance in accordance with claim 9 wherein the probability of selecting a non-losing outcome as the result of a variable probability variable probability trial is less than 50% for some outcomes.

13. A gaming machine comprising:

a) processor means for randomly selecting outcomes, some of which are winners and the remainder being losers; and for awarding credits or money corresponding to said winners, b) display means for displaying the selected outcomes the improvement comprising:

i) said processor means being programmed to designate certain outcomes as a bonus outcome permitting the play of a bonus game; and ii) said processor means being programmed to provide a plurality of trials during bonus game play, said processor iteratively and randomly selecting outcomes as a sequence of variable probability trials, displaying said outcomes and awarding the credits for each winning outcome, wherein credits are accumulated for each winning outcome until a losing outcome is selected wherein the bonus game is ended and credits accumulated in earlier trials are not lost;

whereby a player who reaches the bonus game accumulates credits as a function of the number of variable probability trials survived.

14. A method of operating a gaming machine having a processor for randomly selecting game outcomes and for awarding credits or money for winning outcomes and, a display for displaying said outcomes to a game player comprising the steps of:

a) operating said processor in a basic mode unless and until an outcome, designated as a bonus outcome, is selected, said basic mode permitting outcome selection, display and credit awards only in response to the input of a credit by said player;

b) operating said processor in a bonus mode after said bonus outcome is selected, said bonus mode operation causing:

(1) random selection and display of outcomes as a sequence of variable probability trials which continue until a losing trial occurs;

(2) the award of credits or money for winning outcomes for each trial and when a losing trial occurs, the bonus mode is ended and credits accumulated in earlier trials are not lost;

whereby a player who reaches the bonus mode accumulates credits as a function of the number of variable probability trials survived.

* * * * *